US012454953B2

(12) United States Patent
Matsuzaka et al.

(10) Patent No.: US 12,454,953 B2
(45) Date of Patent: Oct. 28, 2025

(54) GAS COMPRESSOR AND GAS COMPRESSION SYSTEM

(71) Applicant: Hitachi Industrial Equipment Systems Co., Ltd., Tokyo (JP)

(72) Inventors: Takehiro Matsuzaka, Tokyo (JP); Masahiko Takano, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 0 days.

(21) Appl. No.: 18/840,543

(22) PCT Filed: Mar. 3, 2023

(86) PCT No.: PCT/JP2023/008124
§ 371 (c)(1),
(2) Date: Aug. 22, 2024

(87) PCT Pub. No.: WO2023/171575
PCT Pub. Date: Sep. 14, 2023

(65) Prior Publication Data

US 2025/0154954 A1 May 15, 2025

(30) Foreign Application Priority Data

Mar. 11, 2022 (JP) ..... 2022-038642

(51) Int. Cl.
*F04C 18/16* (2006.01)
*F04C 29/02* (2006.01)
*F04C 29/04* (2006.01)

(52) U.S. Cl.
CPC ..... *F04C 18/16* (2013.01); *F04C 29/02* (2013.01); *F04C 29/04* (2013.01); *F04C 2240/30* (2013.01)

(58) Field of Classification Search
CPC ..... F04C 18/16; F04C 29/02; F04C 29/04; F04C 29/12; F04C 29/00; F04C 29/028;
(Continued)

(56) References Cited

U.S. PATENT DOCUMENTS 6,561,766 B2 * 5/2003 Nishimura ..... F04C 23/001 417/252
6,739,841 B2 * 5/2004 Nishimura ..... F04C 23/001 417/252

(Continued)

FOREIGN PATENT DOCUMENTS

JP 56-13607 U 2/1981
JP 2013-241942 A 12/2013

(Continued)

OTHER PUBLICATIONS

International Search Report (PCT/ISA/210) issued in PCT Application No. PCT/JP2023/008124 dated May 23, 2023 with English translation (5 pages).

(Continued)

*Primary Examiner* — Dapinder Singh
(74) *Attorney, Agent, or Firm* — Crowell & Moring LLP

(57) ABSTRACT

A gas compressor includes: a low pressure gas path that introduces compressed gas delivered from a low pressure stage compressor body into a high pressure stage compressor body; a first low pressure gas release valve disposed on a first low pressure branch path branched from the low pressure gas path; a high pressure gas path that introduces the compressed gas delivered from the high pressure stage compressor body to a demand destination; a first high pressure gas release valve disposed on a first high pressure branch path branched from the high pressure gas path; and a control device. The first low pressure branch path is disposed on a downstream side of a heat exchanger for low pressure stage exhaust heat recovery. The first high pressure (Continued)

branch path is disposed on a downstream side of a heat exchanger for high pressure stage exhaust heat recovery. The control device opens the first low pressure gas release valve and the first high pressure gas release valve at a time of switching from load operation to no-load operation.

7 Claims, 8 Drawing Sheets

(58) Field of Classification Search
CPC ..... F04C 29/021; F04C 29/124; F04C 2/16; F04C 28/24; F04C 28/18; F04C 28/26; F04C 2240/30; F01C 1/16; F01C 21/04; F01C 21/18; F04B 35/04; F04B 39/121; F04B 39/02; F04B 39/00; F04B 39/0207; F04B 39/0223; F04B 39/0284
See application file for complete search history.

(56) References Cited

U.S. PATENT DOCUMENTS 9,057,374 B2 * 6/2015 Fujimoto ..... F04C 29/04
10,746,182 B2 * 8/2020 Nakagawa ..... F04D 27/001
2011/0112797 A1 * 5/2011 Nuhse ..... G01M 15/14 702/182
2011/0130883 A1 * 6/2011 Van Dijk ..... F25J 3/0295 700/282
2014/0219820 A1 * 8/2014 Koki ..... F04D 27/0223 417/19
2015/0139776 A1 * 5/2015 Takeda ..... F04D 27/0253 415/17
2017/0234171 A1 8/2017 Matsukuma et al.

FOREIGN PATENT DOCUMENTS

JP 2016-48063 A 4/2016
JP 2021-96043 A 6/2021
JP 2021-169789 A 10/2021

OTHER PUBLICATIONS

Japanese-language Written Opinion (PCT/ISA/237) issued in PCT Application No. PCT/JP2023/008124 dated May 23, 2023 with English translation (7 pages).
International Preliminary Report on Patentability (PCT/IB/338 & PCT/IB/373) issued in PCT Application No. PCT/JP2023/008124 dated Sep. 26, 2024, including English translation of Written Opinion (PCT/ISA/237) (6 pages).

* cited by examiner

GAS COMPRESSOR AND GAS COMPRESSION SYSTEM

TECHNICAL FIELD

The present invention relates to a gas compressor and a gas compression system.

BACKGROUND ART

Patent Document 1 discloses an exhaust heat recovery system including: a gas compressor that has a compressor body for compressing gas, and outputs the compressed gas; and an exhaust heat recovery device that recovers the heat of the compressed gas. The exhaust heat recovery device includes a heat exchanger for exhaust heat recovery and exhaust heat recovery liquid piping through which exhaust heat recovery water that exchanges heat with the compressed gas in the heat exchanger circulates. The exhaust heat recovery system includes: a compressor body in a low pressure stage; a compressor body in a high pressure stage; a heat exchanger for intermediate stage exhaust heat recovery disposed between the compressor body in the low pressure stage and the compressor body in the high pressure stage; and a heat exchanger for delivery stage exhaust heat recovery disposed on the downstream side of the compressor body in the high pressure stage.

In the exhaust heat recovery system, blow-off piping for releasing the compressed gas from gas piping into the atmosphere during no-load operation is provided downstream of the heat exchanger for delivery stage exhaust heat recovery. Therefore, the gas flows through the heat exchanger for intermediate stage exhaust heat recovery and the heat exchanger for delivery stage exhaust heat recovery even during the no-load operation. It is thus possible to perform exhaust heat recovery irrespective of an operation state.

PRIOR ART DOCUMENT

Patent Document

Patent Document 1: JP-2021-96043-A

SUMMARY OF THE INVENTION

Problem to be Solved by the Invention

The exhaust heat recovery system described in Patent Document 1 effects heat exchange between the compressed gas having a high temperature and delivered from the gas compressor and an exhaust heat recovery fluid having a low temperature. However, in such an exhaust heat recovery system, when the gas compressor switches from load operation (loaded operation) to no-load operation (unloaded operation), the temperature of the compressed gas delivered from the gas compressor is decreased as compared with the temperature during the load operation (loaded operation), and therefore the temperature of the exhaust heat recovery fluid is also decreased. There is thus a desire for a technology that can suppress a decrease in the temperature of the exhaust heat recovery fluid during the no-load operation.

It is an object of the present invention to provide a gas compressor and a gas compression system that can suppress a decrease in the temperature of an exhaust heat recovery fluid during no-load operation.

A gas compressor according to one aspect of the present invention includes: a low pressure stage compressor body that compresses gas; an intercooler that cools compressed gas delivered from the low pressure stage compressor body; a high pressure stage compressor body that further compresses the compressed gas cooled by the intercooler; an aftercooler that cools the compressed gas delivered from the high pressure stage compressor body; a low pressure gas path that introduces the compressed gas delivered from the low pressure stage compressor body into the high pressure stage compressor body through the intercooler; a high pressure gas path that introduces the compressed gas delivered from the high pressure stage compressor body to a demand destination through the aftercooler; a first low pressure branch path that is branched from the low pressure gas path; a first low pressure gas release valve that is disposed on the first low pressure branch path and releases the compressed gas delivered from the low pressure stage compressor body; a first high pressure branch path that is branched from the high pressure gas path; a first high pressure gas release valve that is disposed on the first high pressure branch path and releases the compressed gas delivered from the high pressure stage compressor body; and a control device that controls the first low pressure gas release valve and the first high pressure gas release valve. The first low pressure branch path is branched from the low pressure gas path on an upstream side of the intercooler and on a downstream side of a heat exchanger for low pressure stage exhaust heat recovery that effects heat exchange between the compressed gas delivered from the low pressure stage compressor body and a fluid for exhaust heat recovery. The first high pressure branch path is branched from the high pressure gas path on an upstream side of the aftercooler and on a downstream side of a heat exchanger for high pressure stage exhaust heat recovery that effects heat exchange between the compressed gas delivered from the high pressure stage compressor body and the fluid for exhaust heat recovery. The control device effects heat exchange between the compressed gas and the exhaust heat recovery fluid that pass through the heat exchanger for low pressure stage exhaust heat recovery and the heat exchanger for high pressure stage exhaust heat recovery while releasing the compressed gas from the first low pressure gas release valve and the first high pressure gas release valve during no-load operation, by opening the first low pressure gas release valve and the first high pressure gas release valve at a time of switching from load operation to the no-load operation of the low pressure stage compressor body and the high pressure stage compressor body.

Advantages of the Invention

According to the present invention, it is possible to provide a gas compressor and a gas compression system that can suppress a decrease in the temperature of an exhaust heat recovery fluid during no-load operation.

MODES FOR CARRYING OUT THE INVENTION

A gas compressor and a gas compression system according to an embodiment of the present invention will be described with reference to the drawings.

First Embodiment

Figure 1:
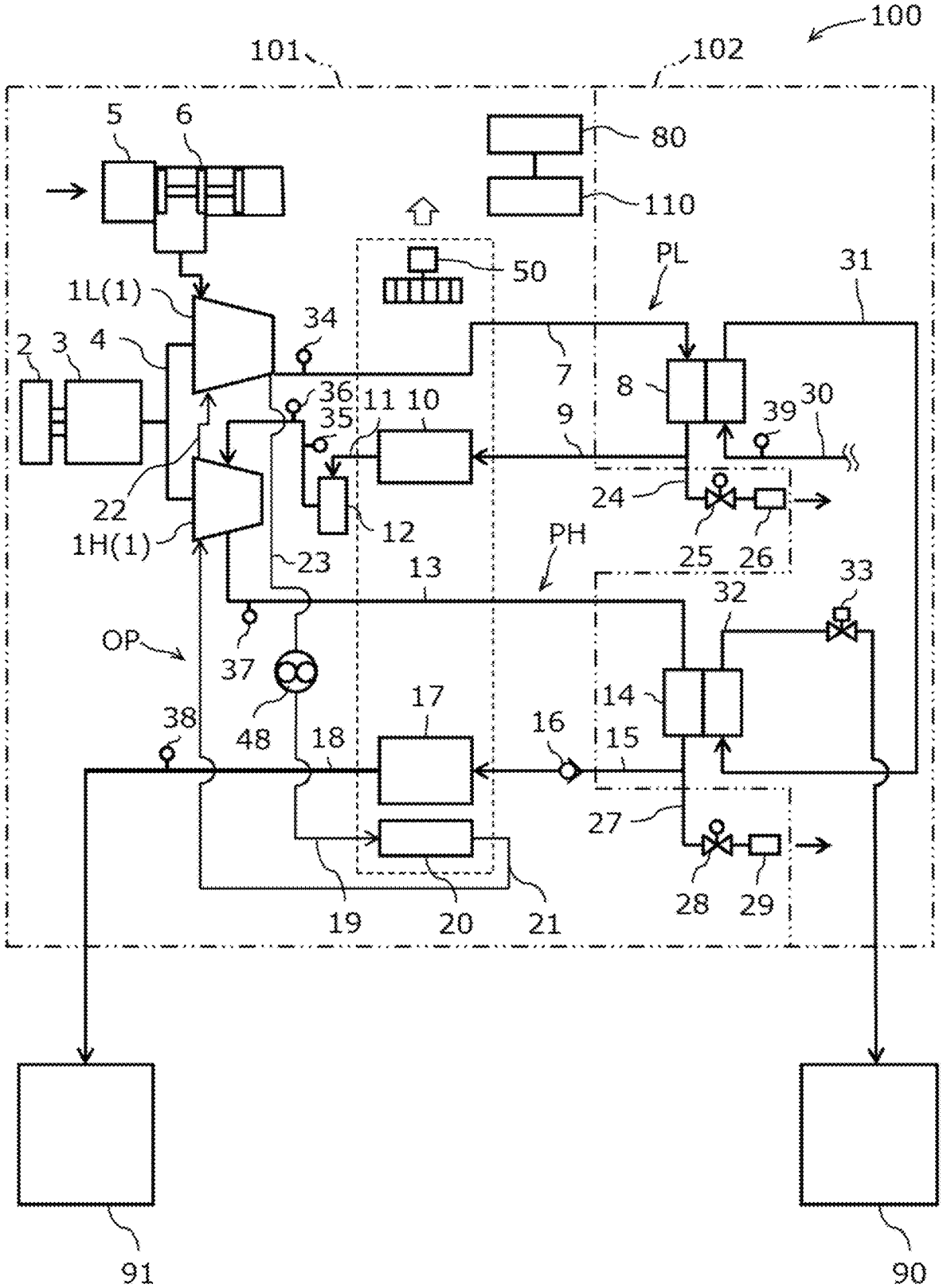
FIG. 1 is a schematic diagram illustrating a general configuration of a gas compression system according to a first embodiment.

A gas compressor 101 and a gas compression system 100 according to a first embodiment will be described with reference to FIG. 1 and FIG. 2. FIG. 1 is a schematic diagram illustrating a general configuration of the gas compression system 100 according to the first embodiment.

<Gas Compression System>

As illustrated in FIG. 1, the gas compression system 100 includes the gas compressor 101 that compresses gas and an exhaust heat recovery device 102. The gas compression system 100 is an exhaust heat recovery system that recovers, by the exhaust heat recovery device 102, the exhaust heat of the compressed gas generated by the gas compressor 101. In the present embodiment, description will be made of a case where the gas compressed by the gas compressor 101 is air, and an exhaust heat recovery fluid that absorbs the heat of the compressed gas (compressed air) by the exhaust heat recovery device 102 is water. In addition, in the present embodiment, description will be made of an example in which the gas compressor 101 is an air-cooled two-stage screw compressor. Incidentally, the gas compression system 100 may be formed as one unit in which the gas compressor 101 and the exhaust heat recovery device 102 are incorporated within one casing, or the gas compressor 101 and the exhaust heat recovery device 102 may be housed within separate casings, and connected to each other by piping. Incidentally, the gas compressor 101 and the exhaust heat recovery device 102 may not be provided with a casing for housing the gas compressor 101 and the exhaust heat recovery device 102, but may be formed as one unit by being fixed to one base frame.

<Gas Compressor>

The gas compressor 101 includes: an electric motor 3 as a driving source; a low pressure stage compressor body 1L that compresses gas; an intercooler 10 that cools the compressed air delivered from the low pressure stage compressor body 1L by a cooling medium; a high pressure stage compressor body 1H that further compresses the compressed air cooled by the intercooler 10; and an aftercooler 17 that cools the compressed air delivered from the high pressure stage compressor body 1H by a cooling medium. The cooling media used by the intercooler 10 and the aftercooler 17 are cooling air generated by a cooling fan 50.

The gas compressor 101 includes: a low pressure gas path PL that introduces the compressed air delivered from the low pressure stage compressor body 1L into the high pressure stage compressor body 1H through the intercooler 10; and a high pressure gas path PH that introduces the compressed air delivered from the high pressure stage compressor body 1H into air using equipment 91 as a demand destination through the aftercooler 17.

The gas compressor 101 includes: a first low pressure branch path 24 branched from the low pressure gas path PL; and a first low pressure gas release valve 25 that is provided to the first low pressure branch path 24, and releases the compressed air delivered from the low pressure stage compressor body 1L.

The gas compressor 101 includes: a first high pressure branch path 27 branched from the high pressure gas path PH; and a first high pressure gas release valve 28 that is provided to the first high pressure branch path 27, and releases the compressed air delivered from the high pressure stage compressor body 1H. Incidentally, a system through which the compressed air flows, which system includes the low pressure gas path PL and the high pressure gas path PH, will be described also as a gas system.

The low pressure stage compressor body 1L and the high pressure stage compressor body 1H each have a similar configuration. Therefore, in the following, the low pressure stage compressor body 1L and the high pressure stage compressor body 1H will be collectively described also as a compressor body 1. The compressor body 1 includes a pair of female and male screw rotors not illustrated and a casing that houses the screw rotors. Incidentally, the gas compressor 101 is an oilless (oil-free) screw compressor in which no oil is supplied to an operation chamber formed by teeth of the screw rotors and an inner wall of the casing. A rotational force of the electric motor 3 is transmitted to the compressor body 1 via a speed increasing device 4. When the electric motor 3 is driven, the screw rotors rotate. When the screw rotors rotate, gas is sucked into the compressor body 1 and compressed therein.

An intake system that supplies air to the low pressure stage compressor body 1L includes: an intake air filter 5 that captures foreign matter (impurity) in the air; and an intake valve 6 that is provided on a downstream side of the intake air filter 5, and is capable of opening and closing a suction port of the low pressure stage compressor body 1L. The intake valve 6 includes a valve body that opens and closes the suction port of the low pressure stage compressor body 1L, and a valve box that houses the valve body. The intake valve 6 is a piston type control valve that operates in response to a control signal from a control device 110 to be described later. The intake valve 6 may have a configuration including an electromagnetic valve body, or may have a configuration including an electromagnetic intake valve control valve provided to a flow passage that introduces the compressed air delivered from the low pressure stage compressor body 1L or the high pressure stage compressor body 1H into a pressure receiving portion of the valve body.

The low pressure stage compressor body 1L sucks air from an ambient atmosphere through the intake air filter 5 and the intake valve 6, and compresses the air. The high pressure stage compressor body 1H sucks the compressed air delivered from the low pressure stage compressor body 1L, and further compresses the compressed air. The compressed air delivered from the high pressure stage compressor body 1H is supplied to the air using equipment 91 as external equipment. The air using equipment 91, for example, uses the compressed air to drive an actuator of a machine within a factory, uses the compressed air to dry an object, or uses the compressed air for cleaning, painting, or the like.

The intercooler 10 and the aftercooler 17 are air-cooled heat exchangers having an internal flow passage through which the compressed air flows. The intercooler 10 and the aftercooler 17 cools the compressed air by effecting heat exchange between cooling air (cooling medium) generated by the cooling fan 50 and the compressed air flowing through the internal flow passage.

The low pressure gas path PL includes an air path 7 connecting the low pressure stage compressor body 1L and a heat exchanger 8 for low pressure stage exhaust heat recovery to be described later to each other, an air path 9 connecting the heat exchanger 8 for low pressure stage exhaust heat recovery and the intercooler 10 to each other, and an air path 11 connecting the intercooler 10 and the high pressure stage compressor body 1H to each other. The air path 7 is provided with a low pressure stage delivery temperature sensor 34 that detects the temperature of the compressed air generated by the low pressure stage compressor body 1L, and outputs a signal indicating a result of the detection to the control device 110.

The first low pressure branch path 24 is connected to the air path 9. That is, the first low pressure branch path 24 is branched from the low pressure gas path PL on the downstream side of the heat exchanger 8 for low pressure stage exhaust heat recovery and on the upstream side of the intercooler 10. The first low pressure branch path 24 is provided with the first low pressure gas release valve 25 that opens or closes the first low pressure branch path 24 in response to a control signal from the control device 110 and a muffler 26 for reducing noise at a time of releasing the compressed air from the first low pressure branch path 24.

The air path 11 is provided with: a condensed water separator (drain separator) 12 that separates condensed water (drain) from the compressed air; a high pressure stage suction temperature sensor 35 that detects the temperature of the compressed air to be sucked into the high pressure stage compressor body 1H, and outputs a signal indicating a result of the detection to the control device 110; and a high pressure stage suction pressure sensor 36 that detects the pressure of the compressed air to be sucked into the high pressure stage compressor body 1H, and outputs a signal indicating a result of the detection to the control device 110.

The high pressure gas path PH includes an air path 13 connecting the high pressure stage compressor body 1H and a heat exchanger 14 for high pressure stage exhaust heat recovery to be described later to each other, an air path 15 connecting the heat exchanger 14 for high pressure stage exhaust heat recovery and the aftercooler 17 to each other, and an air path 18 connecting the aftercooler 17 and the air using equipment 91 to each other. The air path 13 is provided with a high pressure stage delivery temperature sensor 37 that detects the temperature of the compressed air generated by the high pressure stage compressor body 1H, and outputs a signal indicating a result of the detection to the control device 110.

The first high pressure branch path 27 is connected to the air path 15. That is, the first high pressure branch path 27 is branched from the high pressure gas path PH on the downstream side of the heat exchanger 14 for high pressure stage exhaust heat recovery and on the upstream side of the aftercooler 17. The first high pressure branch path 27 is provided with the first high pressure gas release valve 28 that opens or closes the first high pressure branch path 27 in response to a control signal from the control device 110 and a muffler 29 for reducing noise at a time of releasing the compressed air from the first high pressure branch path 27.

The air path 15 is provided with a check valve 16 that allows air to flow from the heat exchanger 14 for high pressure stage exhaust heat recovery to the aftercooler 17, and prohibits air to flow from the aftercooler 17 to the heat exchanger 14 for high pressure stage exhaust heat recovery. The air path 18 is provided with a delivery pressure sensor 38 that detects the delivery pressure of the compressed air delivered from the high pressure stage compressor body 1H, and outputs a signal indicating a result of the detection to the control device 110.

The gas compressor 101 includes the control device 110 that controls an electromagnetic switch 2, the opening and closing of the intake valve 6, the opening and closing of the first low pressure gas release valve 25, and the opening and closing of the first high pressure gas release valve 28.

Figure 2:
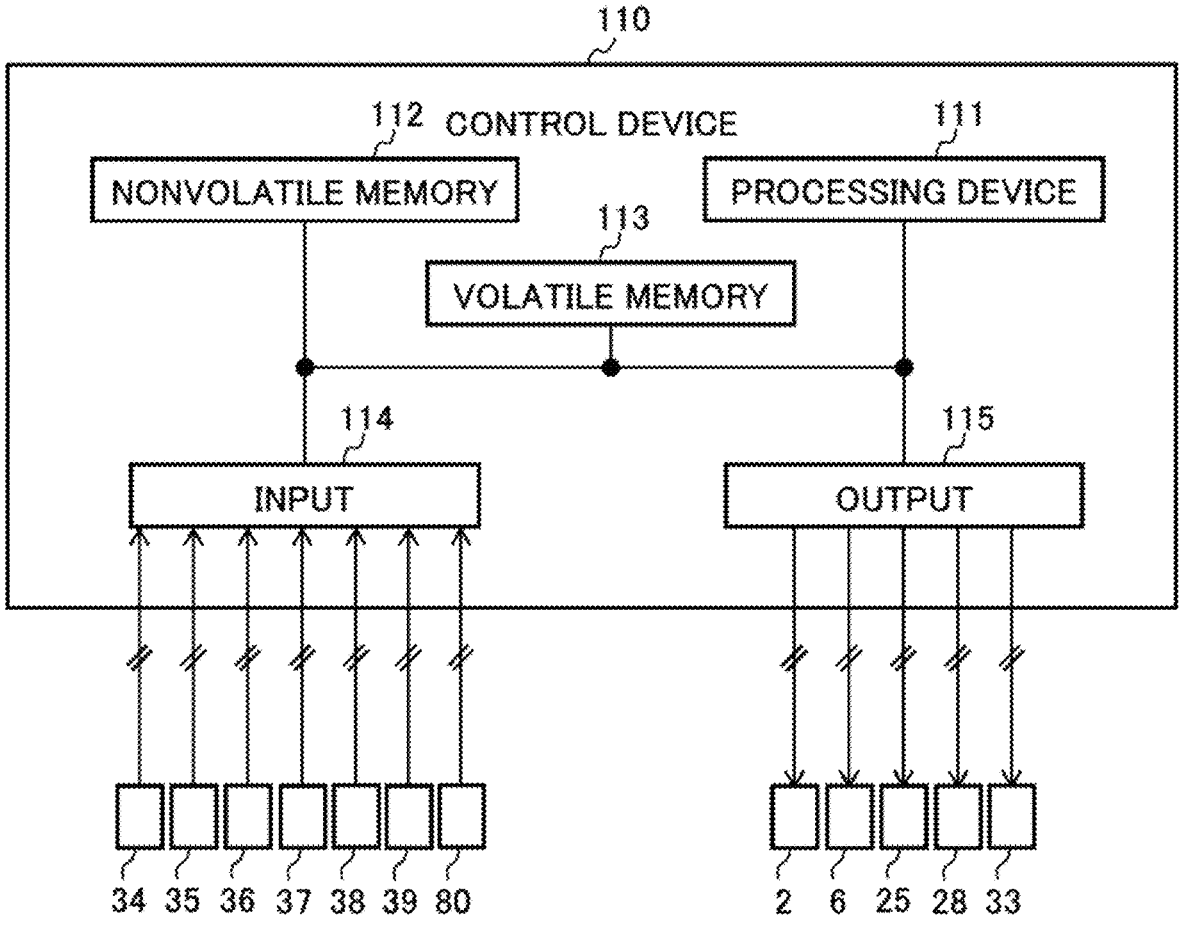
FIG. 2 is a diagram of a hardware configuration of a control device.

FIG. 2 is a diagram of a hardware configuration of the control device 110. As illustrated in FIG. 2, the control device 110 is constituted by a computer including a processing device 111 such as a CPU (Central Processing Unit), an MPU (Micro Processing Unit), or a DSP (Digital Signal Processor), a nonvolatile memory 112 such as a ROM (Read Only Memory), a flash memory, or a hard disk drive, a volatile memory 113 referred to as it is called RAM (Random Access Memory), an input interface 114, an output interface 115, and other peripheral circuitry. Incidentally, the control device 110 may be constituted by one computer, or may be constituted by a plurality of computers. In addition, it is possible to use, as the processing device, an ASIC (application specific integrated circuit), an FPGA (Field Programmable Gate Array), or the like.

The nonvolatile memory 112 stores a program that can perform various kinds of computations. That is, the nonvolatile memory 112 is a storage medium (storage device) from which the program for implementing functions of the present embodiment is readable. The processing device 111 expands the program stored in the nonvolatile memory 112 into the volatile memory 113, and executes the program by computation. The processing device 111 performs predetermined computation processing on data obtained from the input interface 114, the nonvolatile memory 112, and the volatile memory 113 in accordance with the program.

The control device 110 is connected with a plurality of sensors (34 to 39), a plurality of control valves (6, 25, 28, and 33), and an input device 80. The input interface 114 converts signals input from the plurality of sensors (34 to 39) and the input device 80 such that the signals can be subjected to computation by the processing device 111. The output interface 115 generates signals for output according to a result of computation in the processing device 111, and outputs the signals to the plurality of control valves (6, 25, 28, and 33) and the electromagnetic switch 2.

The plurality of sensors (34 to 39) include the low pressure stage delivery temperature sensor 34, the high pressure stage suction temperature sensor 35, the high pressure stage suction pressure sensor 36, the high pressure stage delivery temperature sensor 37, the delivery pressure sensor 38, and a feed water temperature sensor 39. The plurality of control valves (6, 25, 28, and 33) include the intake valve 6, the first low pressure gas release valve 25, the first high pressure gas release valve 28, and a water supply valve 33. The input device 80 is an operation panel provided to the gas compressor 101. The input device 80 includes a plurality of operating units such as operation switches and a touch sensor that can be operated by an operator. The plurality of operating units include a start switch that switches between the operation and stopping of the gas compressor 101.

In the present embodiment, the gas compressor 101 is a constant speed compressor that rotates at a constant rotational speed. The control device 110 operates the electric motor 3 at a constant speed or stops the electric motor 3 by controlling the electromagnetic switch 2.

The control device 110 performs a load operation and a no-load operation of the compressor body 1 on the basis of the delivery pressure of the compressed air detected by the delivery pressure sensor 38. In the load operation, the control device 110 outputs an opening signal to the intake valve 6, and thereby fully opens the intake valve 6. In addition, in the load operation, the control device 110 outputs a closing signal to the first low pressure gas release valve 25 and the first high pressure gas release valve 28, and thereby fully closes the first low pressure gas release valve 25 and the first high pressure gas release valve 28. In the no-load operation, the control device 110 outputs a closing signal to the intake valve 6, and thereby fully closes the intake valve 6. In addition, in the no-load operation, the control device 110 outputs an opening signal to the first low pressure gas release valve 25 and the first high pressure gas release valve 28, and thereby fully opens the first low pressure gas release valve 25 and the first high pressure gas release valve 28. Incidentally, while the intake valve 6 is fully closed, a minute gap is formed between the valve body and the valve box of the intake valve 6, and air is introduced into the low pressure stage compressor body 1L through this gap.

The gas compressor 101 includes a lubricating oil path OP, through which a lubricating oil that lubricates the low pressure stage compressor body 1L and the high pressure stage compressor body 1H flows, and an oil pump 48 and an oil cooler 20 provided to the lubricating oil path OP. The oil pump 48 sucks the lubricating oil from a suction port, and delivers the lubricating oil from a delivery port. The oil pump 48 thereby circulates the lubricating oil within the lubricating oil path OP. The oil cooler 20 cools the lubricating oil by a cooling medium. In the present embodiment, the oil cooler 20 is an air-cooled heat exchanger, and cools the lubricating oil by using the cooling air generated by the cooling fan 50 as the cooling medium.

The lubricating oil path OP includes: an oil supply path 19 that introduces the lubricating oil delivered from the oil pump 48 into the oil cooler 20; an oil supply path 21 that introduces the lubricating oil cooled by the oil cooler 20 into the high pressure stage compressor body 1H; an oil supply path 22 that introduces the lubricating oil discharged from the high pressure stage compressor body 1H into the low pressure stage compressor body 1L; and a return path 23 that returns the lubricating oil discharged from the low pressure stage compressor body 1L to the oil pump 48.

Movable parts within the compressor body 1 and the speed increasing device 4 are lubricated by being supplied with the lubricating oil within the lubricating oil path OP. The movable parts to be lubricated within the compressor body 1 include, for example, bearings supporting the screw rotors and driving parts such as timing gears installed such that the pair of female and male screw rotors can rotate in synchronism with each other in a noncontact manner.

The oil pump 48 causes the lubricating oil to flow through the oil supply path 19, the oil cooler 20, the oil supply path 21, the high pressure stage compressor body 1H, the oil supply path 22, the low pressure stage compressor body 1L, the return path 23, and the oil pump 48 in this order, and thus circulate within the lubricating oil path OP. The movable parts of the compressor body 1 and the speed increasing device 4 are thereby lubricated by the lubricating oil.

<Exhaust Heat Recovery Device>

The exhaust heat recovery device 102 heats water as a fluid for exhaust heat recovery by the heat of the compressed gas generated by the gas compressor 101, and supplies the heated water to heated water using equipment 90 as a demand destination. The exhaust heat recovery device 102 includes the heat exchanger 8 for low pressure stage exhaust heat recovery provided to the low pressure gas path PL, and the heat exchanger 14 for high pressure stage exhaust heat recovery provided to the high pressure gas path PH. The heat exchangers 8 and 14 for exhaust heat recovery have a high temperature fluid flow passage, through which the compressed air generated by the gas compressor 101 flows, and a low temperature fluid flow passage, through which the water supplied from a water supply source (not illustrated) flows. Incidentally, the high temperature fluid flow passage and the low temperature fluid flow passage may be arranged such that a high temperature fluid (compressed air) and a low temperature fluid (water) flow in opposite directions, or the high temperature fluid flow passage and the low temperature fluid flow passage may be arranged such that the high temperature fluid and the low temperature fluid flow in parallel with each other.

The heat exchanger 8 for low pressure stage exhaust heat recovery effects heat exchange between the compressed air delivered from the low pressure stage compressor body 1L and flowing through the high temperature fluid flow passage and the water as the fluid for exhaust heat recovery flowing through the low temperature fluid flow passage. The heat exchanger 14 for high pressure stage exhaust heat recovery effects heat exchange between the compressed air delivered from the high pressure stage compressor body 1H and flowing through the high temperature fluid flow passage and the water as the fluid for exhaust heat recovery flowing through the low temperature fluid flow passage.

The exhaust heat recovery device 102 includes: a first supply flow passage 30 that supplies the water from the water supply source (not illustrated) to the heat exchanger 8 for low pressure stage exhaust heat recovery; a second supply flow passage 31 that supplies the water discharged from the heat exchanger 8 for low pressure stage exhaust heat recovery to the heat exchanger 14 for high pressure stage exhaust heat recovery; and a third supply flow passage 32 that supplies the water discharged from the heat exchanger 14 for high pressure stage exhaust heat recovery to the heated water using equipment 90 as external equipment. Incidentally, a system through which the water flows, which system includes the first supply flow passage 30, the second supply flow passage 31, and the third supply flow passage 32, will be described also as a water supply system.

The first supply flow passage 30 is provided with the feed water temperature sensor 39 that detects the temperature of the water supplied from the water supply source (not illustrated) to the heat exchanger 8 for low pressure stage exhaust heat recovery (feed water temperature), and outputs a signal indicating a result of the detection to the control device 110. The feed water temperature sensor 39 is, for example, a temperature sensor that outputs a signal itself indicating the temperature of the water within the first supply flow passage 30 (feed water temperature). Incidentally, the feed water temperature sensor 39 may be a temperature sensor switch that, when the temperature of the water within the first supply flow passage 30 (feed water temperature) has become a predetermined temperature threshold value or higher, outputs a signal indicating to that effect.

The third supply flow passage 32 is provided with the water supply valve 33 that adjusts the flow rate of the heated water supplied from the exhaust heat recovery device 102 to the heated water using equipment 90. The heated water using equipment 90 is, for example, heat retaining equipment using the heated water, feed water preheating equipment for a boiler, or the like.

<Flow of Control by Control Device>

Figure 3:
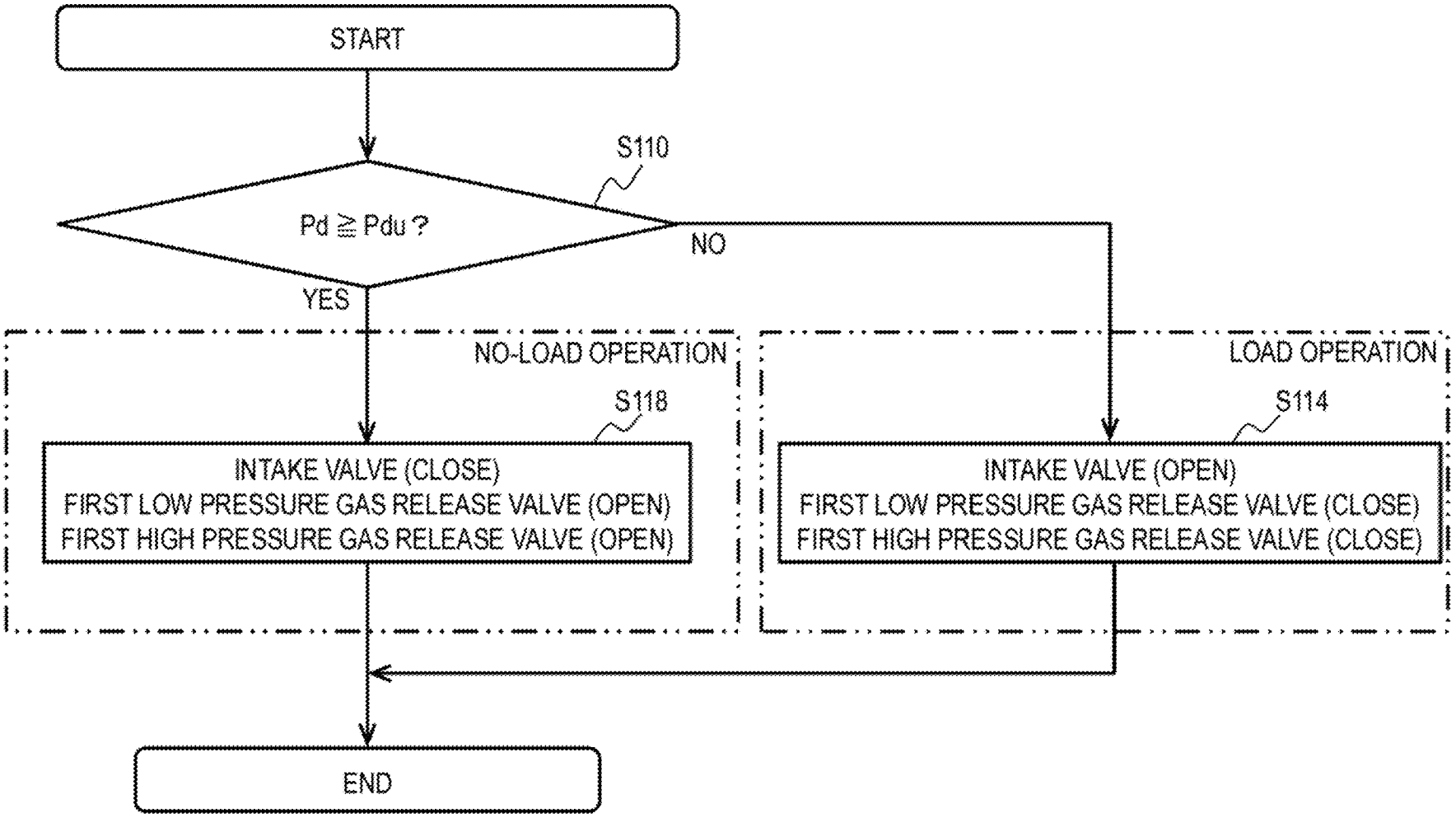
FIG. 3 is a flowchart illustrating an example of a flow of processing of valve control of the gas compression system performed by the control device according to the first embodiment.

FIG. 3 is a flowchart illustrating an example of a flow of processing of valve control of the gas compression system 100 performed by the control device 110. The flowchart illustrated in FIG. 3 is, for example, started by turning on the start switch of the input device 80, and is performed repeatedly in a predetermined control cycle.

In step S110, the control device 110 determines whether or not a delivery pressure Pd detected by the delivery pressure sensor 38 is equal to or higher than a no-load operation start pressure Pdu. The no-load operation start pressure Pdu is a pressure threshold value for determining that the no-load operation is to be started. The no-load operation start pressure Pdu is stored in the nonvolatile memory 112. Incidentally, the no-load operation start pressure Pdu may be allowed to be changed by operation of an operating unit of the input device 80.

When it is determined in step S110 that the delivery pressure Pd is equal to or higher than the no-load operation start pressure Pdu, the processing proceeds to step S118. When it is determined in step S110 that the delivery pressure Pd is lower than the no-load operation start pressure Pdu, the processing proceeds to step S114.

In step S114, the control device 110 outputs an opening signal to the intake valve 6, and outputs a closing signal to the first low pressure gas release valve 25 and the first high pressure gas release valve 28. Thus, the intake valve 6 is opened, and the first low pressure gas release valve 25 and the first high pressure gas release valve 28 are closed.

In step S118, the control device 110 outputs a closing signal to the intake valve 6, and outputs an opening signal to the first low pressure gas release valve 25 and the first high pressure gas release valve 28. Thus, the intake valve 6 is closed, and the first low pressure gas release valve 25 and the first high pressure gas release valve 28 are opened.

When valve control signal output processing (processing of step S114 or step S118) is ended, the processing illustrated in the flowchart of FIG. 3 in the present control cycle is ended.

<Main Operations of Gas Compression System>

Main operations of the gas compression system 100 according to the present embodiment will be described with reference to FIGS. 1 to 3. The control device 110 of the gas compression system 100 performs a load operation of the compressor body 1 when supplying the compressed air to the air using equipment (demand destination) 91. In the load operation, the control device 110 drives the low pressure stage compressor body 1L and the high pressure stage compressor body 1H, and sets the intake valve 6 in an opened state (step S114). Incidentally, in the load operation, the control device 110 sets the first low pressure gas release valve 25 and the first high pressure gas release valve 28 in a closed state (step S114). Thus, outside air (air surrounding the intake valve 6) is sucked into the low pressure stage compressor body 1L through the intake air filter 5 and the intake valve 6. Incidentally, because the intake air filter 5 is provided on the upstream side of the intake valve 6, foreign matter included in the outside air is captured by the intake air filter 5.

The low pressure stage compressor body 1L compresses the air sucked into the low pressure stage compressor body 1L to a predetermined pressure, and delivers the compressed air. The compressed air is raised in temperature due to adiabatic compression by the low pressure stage compressor body 1L, and thus becomes a compressed air having a high temperature. The compressed air generated by the low pressure stage compressor body 1L flows into the high temperature fluid flow passage of the heat exchanger 8 for low pressure stage exhaust heat recovery through the air path 7. Thus, heat exchange is performed between the compressed air flowing through the high temperature fluid flow passage of the heat exchanger 8 for low pressure stage exhaust heat recovery and the water flowing through the low temperature fluid flow passage of the heat exchanger 8 for low pressure stage exhaust heat recovery. The water is consequently heated.

The compressed air after the heat exchange with the water flows out from an outlet of the high temperature fluid flow passage of the heat exchanger 8 for low pressure stage exhaust heat recovery, and flows into the intercooler 10 through the air path 9. The compressed air that has flowed into the intercooler 10 is cooled to a temperature at a level slightly higher than ambient atmospheric temperature through heat exchange with the cooling air. The compressed air cooled by the intercooler 10 flows into the condensed water separator 12 through the air path 11, so that condensed water is removed. The compressed air (compressed air separated from the condensed water) discharged from the condensed water separator 12 is sucked into the high pressure stage compressor body 1H.

The high pressure stage compressor body 1H compresses the compressed air sucked into the high pressure stage compressor body 1H to an even higher predetermined pressure, and delivers the compressed air. The compressed air is raised in temperature again due to adiabatic compression by the high pressure stage compressor body 1H, and thus becomes a compressed air having a high temperature. The compressed air generated by the high pressure stage compressor body 1H flows into the high temperature fluid flow passage of the heat exchanger 14 for high pressure stage exhaust heat recovery through the air path 13. Thus, heat exchange is performed between the compressed air flowing through the high temperature fluid flow passage of the heat exchanger 14 for high pressure stage exhaust heat recovery and the water flowing through the low temperature fluid flow passage of the heat exchanger 14 for high pressure stage exhaust heat recovery. The water is consequently heated.

The compressed air after the heat exchange with the water flows out from an outlet of the high temperature fluid flow passage of the heat exchanger 14 for high pressure stage exhaust heat recovery, and flows into the aftercooler 17 through the air path 15. The compressed air that has flowed into the aftercooler 17 is cooled to a temperature at a level slightly higher than ambient atmospheric temperature through heat exchange with the cooling air. The compressed air cooled by the aftercooler 17 is supplied to the air using equipment (demand destination) 91 through the air path 18.

The water supplied from the water supply source (not illustrated) to the exhaust heat recovery device 102 flows into the low temperature fluid flow passage of the heat exchanger 8 for low pressure stage exhaust heat recovery through the first supply flow passage 30. The water that has flowed into the low temperature fluid flow passage of the heat exchanger 8 is heated by the high-temperature compressed air flowing through the high temperature fluid flow passage of the heat exchanger 8. The water heated by the heat exchanger 8 flows into the low temperature fluid flow passage of the heat exchanger 14 for high pressure stage exhaust heat recovery through the second supply flow passage 31. The water that has flowed into the low temperature fluid flow passage of the heat exchanger 14 is further heated by the high-temperature compressed air flowing through the high temperature fluid flow passage of the heat exchanger 14. The water heated by the heat exchanger 14 is supplied to the heated water using equipment (demand destination) 90 through the third supply flow passage 32.

Hence, according to the present embodiment, when the compressed air generated by the gas compressor 101 passes through the heat exchangers 8 and 14 of the exhaust heat recovery device 102, heat exchange between the compressed air and the water is performed, and thereby exhaust heat is recovered. That is, the heat of the compressed air generated by the gas compressor 101 can be extracted as the heated water. The extracted heated water can be used effectively for various purposes such as the preheating of feed water for the boiler, heat retention, or the like, and makes it possible to decrease or reduce a fuel and electric power necessary to produce the heated water as compared with a case where the heated water is produced without the use of the exhaust heat recovery device 102.

When the delivery pressure Pd of the gas compressor 101 rises and becomes equal to or higher than the no-load operation start pressure Pdu, the control device 110 switches an operation state from the load operation to a no-load operation. When the control device 110 switches from the load operation to the no-load operation of the compressor body 1, the control device 110 closes the intake valve 6 and opens the first low pressure gas release valve 25 and the first high pressure gas release valve 28 (step S118) while continuing the operation of the electric motor 3.

Incidentally, in a state in which the intake valve 6 is closed, a minute gap is formed between the valve box and the valve body of the intake valve 6, and air is sucked into the low pressure stage compressor body 1L through this gap. Hence, during the no-load operation, the amount of the sucked-in air is minimized, and the first low pressure gas release valve 25 and the first high pressure gas release valve 28 are in an opened state. Therefore, during the no-load operation, compression work of the low pressure stage compressor body 1L and the high pressure stage compressor body 1H is decreased, so that power consumption of the gas compressor 101 can be reduced as compared with the load operation. During the no-load operation, an air compression ratio of each of the low pressure stage compressor body 1L and the high pressure stage compressor body 1H is lower than that during the load operation, and therefore the temperature of the compressed air delivered from each compressor body 1 is lower than that during the load operation.

The compressed air delivered from the low pressure stage compressor body 1L during the no-load operation heats the water in the low temperature fluid flow passage of the heat exchanger 8 while passing through the high temperature fluid flow passage of the heat exchanger 8 for low pressure stage exhaust heat recovery. The compressed air thereafter flows out from the outlet of the high temperature fluid flow passage of the heat exchanger 8 for low pressure stage exhaust heat recovery. In the no-load operation, the first low pressure gas release valve 25 is in an opened state, and therefore a part of the compressed air that has flowed out from the heat exchanger 8 is released into the atmosphere through the first low pressure branch path 24 branched from the air path 9 and the muffler 26.

The compressed air not completely released from the first low pressure branch path 24 is sucked into the high pressure stage compressor body 1H. The compressed air delivered from the high pressure stage compressor body 1H heats the water in the low temperature fluid flow passage of the heat exchanger 14 while passing through the high temperature fluid flow passage of the heat exchanger 14 for high pressure stage exhaust heat recovery. The compressed air thereafter flows out from the outlet of the high temperature fluid flow passage of the heat exchanger 14 for high pressure stage exhaust heat recovery. In the no-load operation, the first high pressure gas release valve 28 is in an opened state, and therefore the compressed air that has flowed out from the heat exchanger 14 is released into the atmosphere through the first high pressure branch path 27 branched from the air path 15 and the muffler 29.

Incidentally, during the no-load operation, an amount of air used in the air using equipment 91 is small, and a pressure on the downstream side of the check valve 16 provided to the air path 15 (that is, the delivery pressure Pd) is higher than a pressure on the upstream side of the check valve 16. Therefore, the check valve 16 receives a back pressure, and is set in a closed state. Hence, during the no-load operation, the compressed air delivered from the high pressure stage compressor body 1H is released into the atmosphere through the first high pressure branch path 27 without flowing into the aftercooler 17.

Thus, in the present embodiment, at a time of switching from the load operation to the no-load operation, the control device 110 opens the first low pressure gas release valve 25 and the first high pressure gas release valve 28. During the no-load operation, the control device 110 thereby effects heat exchange between the compressed air and the water passing through the heat exchanger 8 for low pressure stage exhaust heat recovery and the heat exchanger 14 for high pressure stage exhaust heat recovery while releasing the compressed gas from the first low pressure gas release valve 25 and the first high pressure gas release valve 28.

Effects obtained by the gas compressor 101 and the gas compression system 100 according to the present embodiment configured as described above will be described by comparison with a configuration provided with none of the first low pressure branch path 24, the first low pressure gas release valve 25, and the muffler 26 (which configuration will hereinafter be written as a comparative example). In the comparative example, during the no-load operation, the compressed air is released into the atmosphere via only the first high pressure gas release valve 28. On the other hand, in the present embodiment, during the no-load operation, the compressed air is released into the atmosphere via the first low pressure gas release valve 25 and the first high pressure gas release valve 28.

In the present embodiment, the compressed air is released into the atmosphere via the first low pressure gas release valve 25, and therefore the pressure of the compressed air within the air path 11 between the low pressure stage compressor body 1L and the high pressure stage compressor body 1H (that is, a high pressure stage suction pressure) is lower than that in the comparative example. Hence, in the present embodiment, the compression ratio of the high pressure stage compressor body 1H during the no-load operation is higher than that in the comparative example. As a result, in the present embodiment, the temperature of the compressed air delivered from the high pressure stage compressor body 1H (high pressure stage delivery temperature) is higher than that in the comparative example.

Thus, in the present embodiment, it is possible to make the high pressure stage delivery temperature higher than that in the comparative example, and heat the water flowing through the low temperature fluid flow passage of the heat exchanger 14 for high pressure stage exhaust heat recovery, by the compressed air having a higher temperature than in the comparative example. Hence, in the present embodiment, the temperature of the water flowing out from the heat exchanger 14 for high pressure stage exhaust heat recovery at the time of the no-load operation can be made higher than that in the comparative example.

Effects

The foregoing embodiment produces the following actions and effects.

At a time of switching from the load operation to the no-load operation of the low pressure stage compressor body 1L and the high pressure stage compressor body 1H, the control device 110 opens the first low pressure gas release valve 25 and the first high pressure gas release valve 28. During the no-load operation, the control device 110 thereby effects heat exchange between the compressed air (compressed gas) and the water (exhaust heat recovery fluid) passing through the heat exchanger 8 for low pressure stage exhaust heat recovery and the heat exchanger 14 for high pressure stage exhaust heat recovery while releasing the compressed gas from the first low pressure gas release valve 25 and the first high pressure gas release valve 28.

With this configuration, the gas compressor 101 including compressor bodies in a plurality of stages can not only release air on the downstream side of the high pressure stage compressor body 1H but also release air on the upstream side of the high pressure stage compressor body 1H during the no-load operation. It is thereby possible to raise the compression ratio of the high pressure stage compressor body 1H, and consequently raise the temperature of the air compressed by the high pressure stage compressor body 1H. That is, according to the present embodiment, it is possible to provide the gas compressor 101 and the gas compression system 100 that can suppress a decrease in the temperature of the water during the no-load operation. In other words, according to the present embodiment, it is possible to provide the gas compressor 101 and the gas compression system 100 that have high exhaust heat recovery efficiency during the no-load operation.

Second Embodiment

A gas compressor 201 and a gas compression system 200 according to a second embodiment of the present invention will be described with reference to FIG. 4 and FIG. 5. Incidentally, configurations identical or corresponding to the configurations described in the first embodiment are identified by the same reference numerals, and differences will be mainly described.

Figure 4:
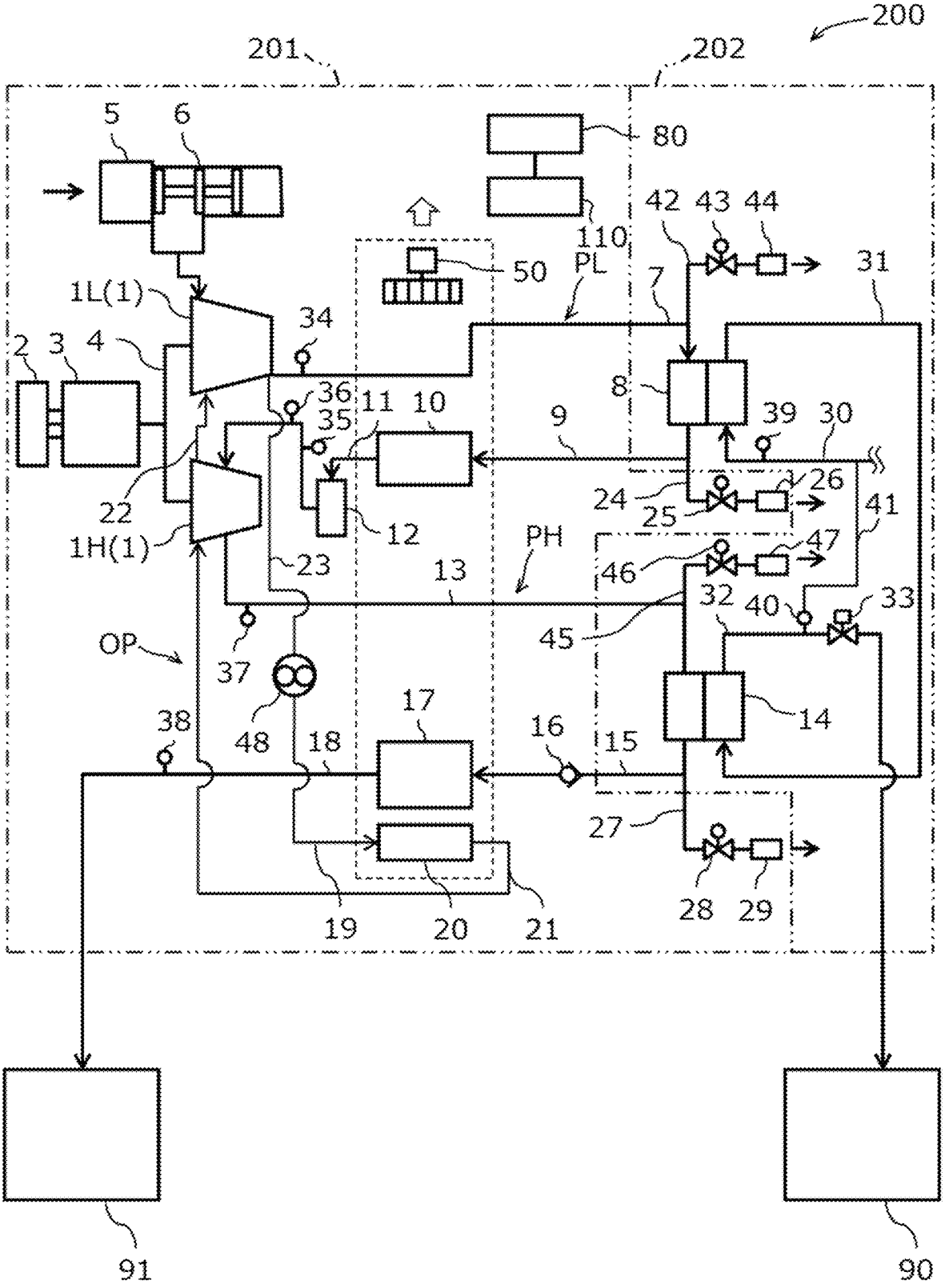
FIG. 4 is a schematic diagram illustrating a general configuration of a gas compression system according to a second embodiment.

FIG. 4 is a schematic diagram illustrating a general configuration of the gas compression system 200 according to the present second embodiment. As in the first embodiment, the gas compression system 200 according to the present second embodiment has a function of performing exhaust heat recovery during the no-load operation. The present second embodiment is different from the foregoing first embodiment in that the present second embodiment can switch the exhaust heat recovery function during the no-load operation to an enabled state or a disabled state.

As illustrated in FIG. 4, the gas compression system 200 according to the second embodiment has a configuration similar to that of the gas compression system 100 according to the first embodiment. Further, an exhaust heat recovery device 202 of the gas compression system 200 according to the second embodiment includes: a second low pressure branch path 42 branched from the low pressure gas path PL on the upstream side of the heat exchanger 8 for low pressure stage exhaust heat recovery; a second low pressure gas release valve 43 provided to the second low pressure branch path 42; a second high pressure branch path 45 branched from the high pressure gas path PH on the upstream side of the heat exchanger 14 for high pressure stage exhaust heat recovery; and a second high pressure gas release valve 46 provided to the second high pressure branch path 45. Incidentally, a gas releasing unit on the second low pressure branch path 42 is provided with a muffler 44, and a gas releasing unit on the second high pressure branch path 45 is provided with a muffler 47.

The exhaust heat recovery device 202 of the gas compression system 200 according to the second embodiment includes a differential pressure sensor 40. The differential pressure sensor 40 is provided between the first supply flow passage 30 and the third supply flow passage 32. The differential pressure sensor 40 detects a differential pressure between the pressure of the water within the first supply flow passage 30 and the pressure of the water within the third supply flow passage 32, and outputs a signal indicating a result of the detection to the control device 110. The differential pressure sensor 40 is provided to a pressure detection pipe 41 that connects the first supply flow passage 30 to the third supply flow passage 32 on the downstream side of the heat exchanger 14 for high pressure stage exhaust heat recovery and on the upstream side of the water supply valve 33. The differential pressure sensor 40 outputs, for example, a signal itself indicating the detected differential pressure. Incidentally, the differential pressure sensor 40 may be a differential pressure sensor switch that, when the detected differential pressure becomes equal to or lower than a predetermined differential pressure threshold value, outputs a signal to that effect.

The control device 110 determines whether or not a disabling condition for disabling the exhaust heat recovery function during the no-load operation is satisfied.

The disabling condition includes a first condition and a second condition in the following, and is satisfied when at least one of the first condition and the second condition is satisfied. The disabling condition is not satisfied when neither the first condition nor the second condition in the following is satisfied.

First condition: at least one of the heat exchanger 8 for low pressure stage exhaust heat recovery and the heat exchanger 14 for high pressure stage exhaust heat recovery is not being supplied with the water.

Second condition: a temperature (feed water temperature) Tw1 of the water supplied to at least one of the heat exchanger 8 for low pressure stage exhaust heat recovery and the heat exchanger 14 for high pressure stage exhaust heat recovery is higher than a temperature threshold value Twh.

Specifically, the control device 110 determines whether or not a differential pressure ΔPw detected by the differential pressure sensor 40 is equal to or lower than a differential pressure threshold value ΔPwl. The differential pressure ΔPw is increased as the flow rate of the water passing through the heat exchangers 8 and 14 for exhaust heat recovery becomes higher. The differential pressure threshold value ΔPwl is set to determine whether or not the water is being supplied to the heat exchangers 8 and 14 for exhaust heat recovery. The differential pressure threshold value ΔPwl is stored in the nonvolatile memory 112 in advance.

When the differential pressure ΔPw is equal to or lower than the differential pressure threshold value ΔPwl, the control device 110 determines that the water is not being supplied to the heat exchangers 8 and 14 for exhaust heat recovery. That is, when the differential pressure ΔPw is equal to or lower than the differential pressure threshold value ΔPwl, the control device 110 determines that the first condition is satisfied. When the differential pressure ΔPw is higher than the differential pressure threshold value ΔPwl, the control device 110 determines that the water is being supplied to the heat exchangers 8 and 14 for exhaust heat recovery. That is, when the differential pressure ΔPw is higher than the differential pressure threshold value ΔPwl, the control device 110 determines that the first condition is not satisfied.

The heated water using equipment 91 may be provided with a heated water tank and a heated water pump in the water supply system, and raise the temperature of the water by circulating the water. In the heated water using equipment 91, when a state in which the water supply system is not replenished with makeup water having a low temperature is continued, a temperature difference between the water and the compressed air may become very small. In addition, the temperature of the compressed air is decreased by switching from the load operation to the no-load operation. On the other hand, when the temperature of the water within the water supply system remains high, the temperature of the water may become higher than the temperature of the compressed air.

Hence, it is preferable to disable the exhaust heat recovery function when the temperature of the water is very close to the temperature of the compressed air during the no-load operation or when the temperature of the water exceeds the temperature of the compressed air during the no-load operation.

The control device 110 determines whether or not the feed water temperature Tw1 detected by the feed water temperature sensor 39 is equal to or higher than the temperature threshold value Twh. The temperature threshold value Twh is set in advance on the basis of a result of an experiment or the like, and is stored in the nonvolatile memory 112. The temperature threshold value Twh is set on the basis of a temperature Td1 of the compressed air delivered from the low pressure stage compressor body 1L during the no-load operation (which temperature will hereinafter be referred to as a low pressure stage delivery temperature) and a temperature Td2 of the compressed air delivered from the high pressure stage compressor body 1H during the no-load operation (which temperature will hereinafter be referred to as a high pressure stage delivery temperature). For example, the temperature threshold value Twh is a minimum value of the low pressure stage delivery temperature Td1 and the high pressure stage delivery temperature Td2 during the no-load operation.

The control device 110 determines that the second condition is satisfied when the feed water temperature Tw1 is equal to or higher than the temperature threshold value Twh. The control device 110 determines that the second condition is not satisfied when the feed water temperature Tw1 is lower than the temperature threshold value Twh.

In the load operation of the compressor body 1, the control device 110 fully opens the intake valve 6, and fully closes the first low pressure gas release valve 25, the first high pressure gas release valve 28, the second low pressure gas release valve 43, and the second high pressure gas release valve 46.

When the disabling condition is not satisfied, the control device 110 enables the exhaust heat recovery function during the no-load operation. When the disabling condition is satisfied, the control device 110 disables the exhaust heat recovery function during the no-load operation. Incidentally, whether or not the disabling condition is satisfied may be determined after switching from the load operation to the no-load operation, or may be determined in advance during the load operation.

Specifically, when the disabling condition is not satisfied, the control device 110 fully opens the first low pressure gas release valve 25 and the first high pressure gas release valve 28 and fully closes the second low pressure gas release valve 43 and the second high pressure gas release valve 46 at a time of switching from the load operation to the no-load operation of the compressor body 1. In this state, as in the first embodiment, the compressed air flows into the heat exchanger 8 for low pressure stage exhaust heat recovery and the heat exchanger 14 for high pressure stage exhaust heat recovery, and the water is heated by the compressed air. That is, in this state, the exhaust heat recovery function during the no-load operation is enabled.

When the disabling condition is satisfied, on the other hand, the control device 110 fully opens at least the second low pressure gas release valve 43 and the second high pressure gas release valve 46 at a time of switching from the load operation to the no-load operation of the compressor body 1. Thus, a part of the compressed air delivered from the low pressure stage compressor body 1L is released on the upstream side of the heat exchanger 8 for low pressure stage exhaust heat recovery. In addition, the compressed air delivered from the high pressure stage compressor body 1H is released on the upstream side of the heat exchanger 14 for high pressure stage exhaust heat recovery. In this state, the compressed air flowing into the heat exchanger 8 for low pressure stage exhaust heat recovery and the heat exchanger 14 for high pressure stage exhaust heat recovery is reduced significantly as compared with the first embodiment, and an amount of heat transmitted from the compressed air to the water is decreased. That is, in this state, the exhaust heat recovery function during the no-load operation is disabled.

Figure 5:
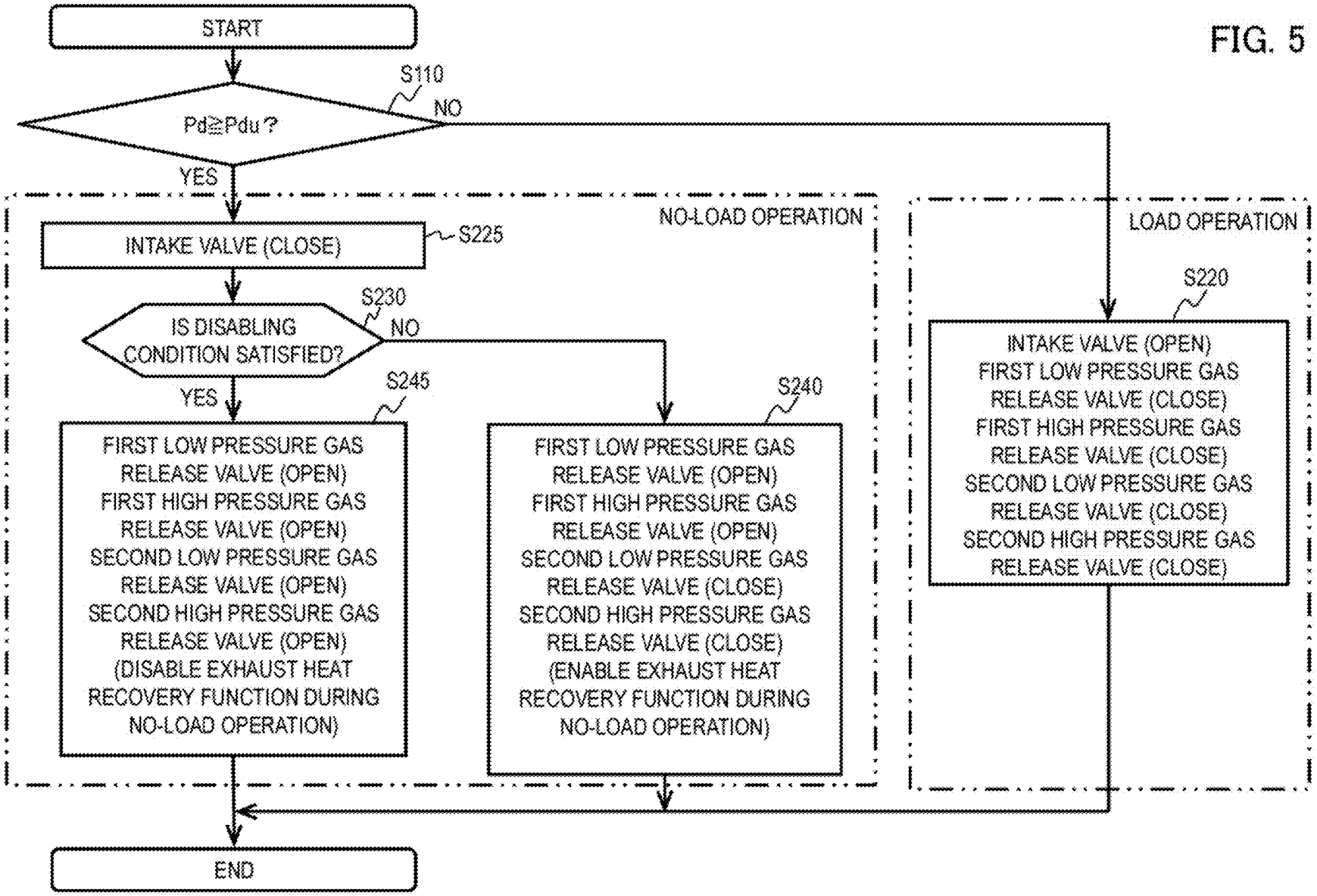
FIG. 5 is a flowchart illustrating an example of a flow of processing of valve control of the gas compression system performed by a control device according to the second embodiment.

FIG. 5 is a flowchart illustrating an example of a flow of processing of valve control of the gas compression system 200 performed by the control device 110 according to the second embodiment. In the flowchart of FIG. 5, the processing of steps S220 to S245 is performed in place of the processing of steps S114 and S118 in the flowchart of FIG. 3. The flowchart illustrated in FIG. 5 is, for example, started by turning on the start switch of the input device 80, and is repeatedly performed in a predetermined control cycle.

In step S110, as in the first embodiment, the control device 110 determines whether or not the delivery pressure Pd detected by the delivery pressure sensor 38 is equal to or higher than the no-load operation start pressure Pdu. When it is determined in step S110 that the delivery pressure Pd is equal to or higher than the no-load operation start pressure Pdu, the processing proceeds to step S225. When it is determined in step S110 that the delivery pressure Pd is lower than the no-load operation start pressure Pdu, the processing proceeds to step S220.

In step S220, the control device 110 outputs an opening signal to the intake valve 6, and outputs a closing signal to the first low pressure gas release valve 25, the first high pressure gas release valve 28, the second low pressure gas release valve 43, and the second high pressure gas release valve 46.

In step S225, the control device 110 outputs a closing signal to the intake valve 6. The control device 110 then advances the processing to step S230.

In step S230, the control device 110 determines whether or not the disabling condition is satisfied on the basis of a detection result of the differential pressure sensor 40 and a detection result of the feed water temperature sensor 39. In step S230, the control device 110 determines that the disabling condition is not satisfied when neither the first condition nor the second condition is satisfied. The control device 110 then advances the processing to step S240. In step S230, the control device 110 determines that the disabling condition is satisfied when at least one of the first condition and the second condition is satisfied. The control device 110 then advances the processing to step S245.

In step S240, the control device 110 outputs an opening signal to the first low pressure gas release valve 25 and the first high pressure gas release valve 28, and outputs a closing signal to the second low pressure gas release valve 43 and the second high pressure gas release valve 46. The control device 110 thereby enables the exhaust heat recovery function during the no-load operation.

In step S245, the control device 110 outputs an opening signal to the first low pressure gas release valve 25, the first high pressure gas release valve 28, the second low pressure gas release valve 43, and the second high pressure gas release valve 46. The control device 110 thereby disables the exhaust heat recovery function during the no-load operation.

When the valve control signal output processing (processing of step S220, step S240, or step S245) is ended, the processing illustrated in the flowchart of FIG. 5 in the present control cycle is ended.

Characteristic operations of the gas compression system 200 according to the present second embodiment will be described with reference to FIG. 4 and FIG. 5. When the delivery pressure Pd of the gas compressor 201 rises and becomes equal to or higher than the no-load operation start pressure Pdu, the control device 110 of the gas compression system 200 switches the operation state from the load operation to the no-load operation.

When the control device 110 switches from the load operation to the no-load operation of the compressor body 1, the control device 110 closes the intake valve 6 while continuing the operation of the electric motor 3 (step S225). When there is supply of water from the water supply source (not illustrated) to the heat exchangers 8 and 14 for exhaust heat recovery, and the feed water temperature Tw1 is lower than the temperature threshold value Twh, the second low pressure gas release valve 43 and the second high pressure gas release valve 46 are maintained in a closed state (No in step S230 and then step S240), and the first low pressure gas release valve 25 and the first high pressure gas release valve 28 are opened. Therefore, as in the first embodiment, the exhaust heat recovery function is enabled, so that a decrease in the temperature of the water during the no-load operation can be suppressed.

When there is no supply of water from the water supply source (not illustrated) to the heat exchangers 8 and 14 for exhaust heat recovery, or when the feed water temperature Tw1 is equal to or higher than the temperature threshold value Twh, not only the first low pressure gas release valve 25 and the first high pressure gas release valve 28 but also the second low pressure gas release valve 43 and the second high pressure gas release valve 46 are opened (Yes in step S230 and then step S245). Consequently, the compressed air is quickly released into the atmosphere, so that exhaust heat recovery is hardly performed. The exhaust heat recovery function can be thus disabled.

As described above, the gas compression system 200 according to the present second embodiment includes: the second low pressure gas release valve 43 provided on the upstream side of the heat exchanger 8 for low pressure stage exhaust heat recovery in the gas system; the second high pressure gas release valve 46 provided on the upstream side of the heat exchanger 14 for high pressure stage exhaust heat recovery in the gas system; the differential pressure sensor 40 provided to detect whether water supply to the heat exchangers 8 and 14 for exhaust heat recovery is being performed; and the feed water temperature sensor 39 provided to detect that the feed water temperature has risen to a temperature close to that of the compressed air.

The control device 110 determines whether or not the disabling condition for disabling the exhaust heat recovery function during the no-load operation is satisfied on the basis of a detection result of the differential pressure sensor 40 and a detection result of the feed water temperature sensor 39. The control device 110 determines that the disabling condition is satisfied when the differential pressure ΔPw detected by the differential pressure sensor 40 is lower than the differential pressure threshold value ΔPwl or when the feed water temperature Tw1 detected by the feed water temperature sensor 39 is higher than the temperature threshold value Twh. The control device 110 determines that the disabling condition is not satisfied when the differential pressure ΔPw detected by the differential pressure sensor 40 is higher than the differential pressure threshold value ΔPwl and when the feed water temperature Tw1 detected by the feed water temperature sensor 39 is lower than the temperature threshold value Twh.

When the disabling condition is not satisfied, the control device 110 opens the first low pressure gas release valve 25 and the first high pressure gas release valve 28 and closes the second low pressure gas release valve 43 and the second high pressure gas release valve 46 at a time of switching from the load operation to the no-load operation of the low pressure stage compressor body 1L and the high pressure stage compressor body 1H. When the disabling condition is satisfied, the control device 110 opens at least the second low pressure gas release valve 43 and the second high pressure gas release valve 46 at the time of switching from the load operation to the no-load operation of the low pressure stage compressor body 1L and the high pressure stage compressor body 1H.

According to this configuration, during the no-load operation, the second low pressure gas release valve 43 and the second high pressure gas release valve 46 are opened when water supply to the heat exchangers 8 and 14 for exhaust heat recovery is not performed or when the feed water temperature has become equal to or higher than the temperature of the compressed air. The exhaust heat recovery function during the no-load operation is thereby disabled. The flow rate of the compressed air supplied to the heat exchangers 8 and 14 for exhaust heat recovery is kept low. A pressure loss occurring when the compressed air flows through the heat exchangers 8 and 14 for exhaust heat recovery is therefore kept low. That is, in a case where the disabling condition is satisfied during the no-load operation, the pressure loss is reduced, and therefore power consumption of the electric motor 3 can be reduced, as compared with a case where the disabling condition is not satisfied. Hence, the gas compressor 201 and the gas compression system 200 according to the present second embodiment can enhance energy saving efficiency as compared with the first embodiment.

In addition, in the present second embodiment, when the disabling condition is satisfied, the control device 110 opens the first low pressure gas release valve 25, the first high pressure gas release valve 28, the second low pressure gas release valve 43, and the second high pressure gas release valve 46 at a time of switching from the load operation to the no-load operation of the low pressure stage compressor body 1L and the high pressure stage compressor body 1H. Hence, as compared with a case where the first low pressure gas release valve 25 and the first high pressure gas release valve 28 are closed, a large amount of compressed air can be quickly released into the atmosphere. As a result, the energy saving efficiency can be further enhanced.

Third Embodiment

A gas compressor 301 and a gas compression system 300 according to a third embodiment of the present invention will be described with reference to FIG. 6 and FIG. 7. Incidentally, configurations identical or corresponding to the configurations described in the second embodiment are identified by the same reference numerals, and differences will be mainly described.

Figure 6:
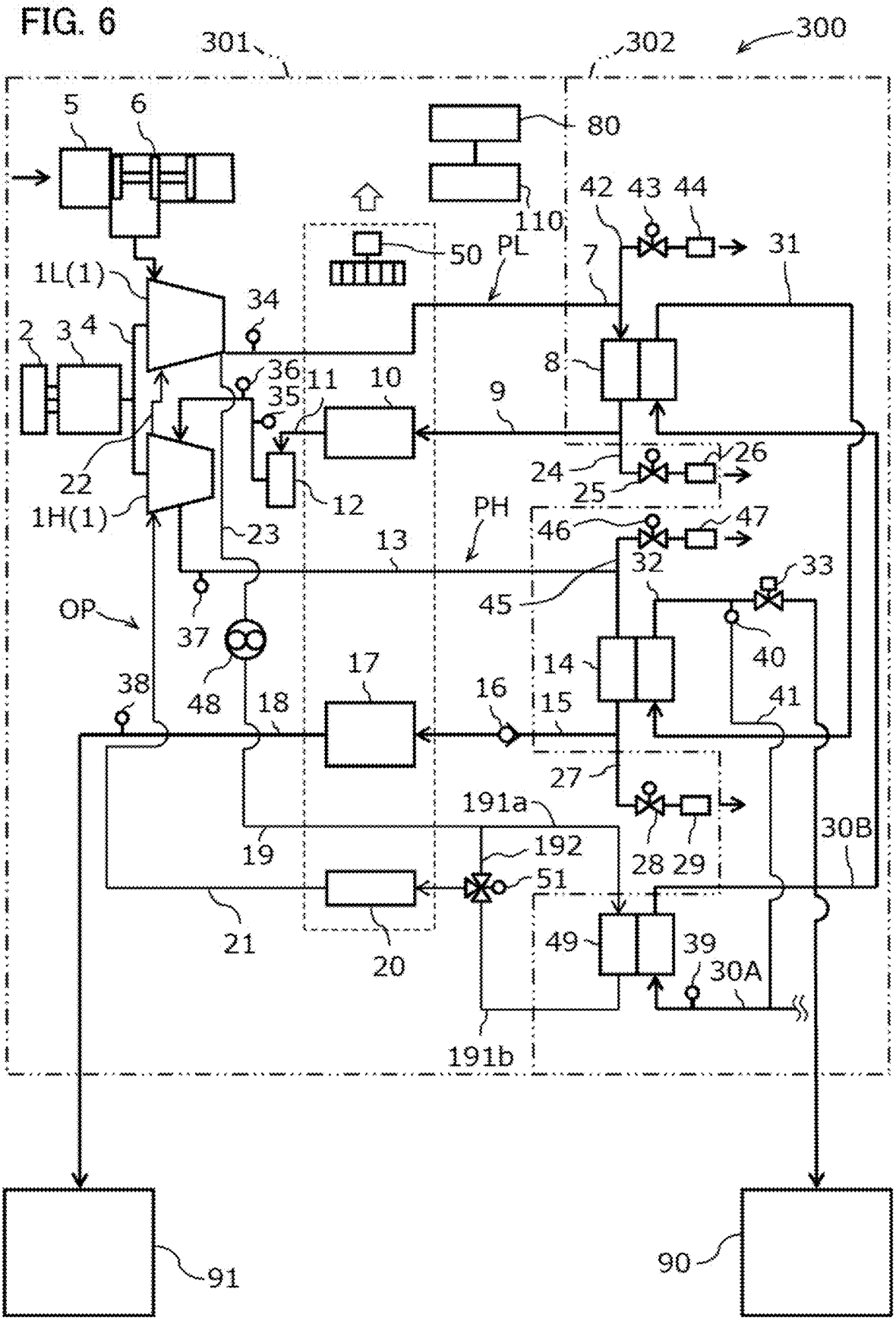
FIG. 6 is a schematic diagram illustrating a general configuration of a gas compression system according to a third embodiment.

FIG. 6 is a schematic diagram illustrating a general configuration of the gas compression system 300 according to the present third embodiment. The gas compression system 300 according to the present third embodiment has a configuration similar to that of the gas compression system 200 according to the second embodiment. Further, an exhaust heat recovery device 302 of the gas compression system 300 according to the third embodiment includes a heat exchanger 49 for lubricating oil exhaust heat recovery that is provided to the lubricating oil path OP, and which effects heat exchange between the lubricating oil and the water. The heat exchanger 49 has a high temperature fluid flow passage, through which the lubricating oil flows, and a low temperature fluid flow passage, through which the water supplied from the water supply source (not illustrated) flows.

When exhaust heat recovery is performed from the compressed air having a high temperature as in an oilless air compressor, the temperature of the lubricating oil is significantly low as compared with the temperature of the compressed air immediately after being delivered from each compressor body 1 during the load operation. Therefore, exhaust heat recovery from the lubricating oil is often not performed actively. However, an amount of decrease in lubricating oil temperature at a time of switching from the load operation to the no-load operation is smaller than an amount of decrease in the temperature of the compressed air. Therefore, the lubricating oil during the no-load operation is valuable for use in the exhaust heat recovery as compared with the lubricating oil during the load operation.

The temperature of the lubricating oil is lower than the temperature of the compressed air delivered from the low pressure stage compressor body 1L during the no-load operation and the temperature of the compressed air delivered from the high pressure stage compressor body 1H during the no-load operation. Accordingly, in the water supply system illustrated in FIG. 6 in the present embodiment, the heat exchanger 49 for lubricating oil exhaust heat recovery is disposed so as to effect heat exchange first between the water having a low temperature immediately after being supplied from the water supply source, where the feed water temperature is lowest, and the lubricating oil. It is thereby possible to enhance exhaust heat recovery efficiency by increasing a temperature difference between the lubricating oil and the water as much as possible. Further, the heat exchangers 49, 8, and 14 are connected in series with each other such that the water preheated by the lubricating oil passes through the heat exchanger 8 for low pressure stage exhaust heat recovery and the heat exchanger 14 for high pressure stage exhaust heat recovery in this order. Because the heat exchanger 49 for lubricating oil exhaust heat recovery is thus disposed on the upstream side of the heat exchangers 8 and 14 in the water supply system, the feed water temperature can be raised effectively.

The lubricating oil pumped by the oil pump 48 flows into the high temperature fluid flow passage of the heat exchanger 49 for lubricating oil exhaust heat recovery, and heats the water as a low temperature fluid. The lubricating oil flowing out from an outlet of the high temperature fluid flow passage of the heat exchanger 49 for lubricating oil exhaust heat recovery passes through the oil cooler 20 to be cooled by the cooling air, and is then supplied to the movable parts within the compressor body 1 and the speed increasing device 4.

The water supplied from the water supply source (not illustrated) to the exhaust heat recovery device 302 flows into the low temperature fluid flow passage of the heat exchanger 49 for lubricating oil exhaust heat recovery through an upstream side first supply flow passage 30A. The water that has flowed into the low temperature fluid flow passage of the heat exchanger 49 is heated by the lubricating oil flowing through the high temperature fluid flow passage of the heat exchanger 49. The water heated by the heat exchanger 49 flows into the low temperature fluid flow passage of the heat exchanger 8 for low pressure stage exhaust heat recovery through a downstream side first supply flow passage 30B. The water that has flowed into the low temperature fluid flow passage of the heat exchanger 8 is further heated by the high-temperature compressed air flowing through the high temperature fluid flow passage of the heat exchanger 8. The water heated by the heat exchanger 8 flows into the low temperature fluid flow passage of the heat exchanger 14 for high pressure stage exhaust heat recovery through the second supply flow passage 31. The water that has flowed into the low temperature fluid flow passage of the heat exchanger 14 is further heated by the high-temperature compressed air flowing through the high temperature fluid flow passage of the heat exchanger 14. The water heated by the heat exchanger 14 is supplied to the heated water using equipment (demand destination) 90 through the third supply flow passage 32.

The lubricating oil path OP includes: a main path 191*a* on the upstream side of the heat exchanger which main path introduces the lubricating oil into the heat exchanger 49 for lubricating oil exhaust heat recovery; a main path 191*b* on the downstream side of the heat exchanger which main path introduces the lubricating oil from the heat exchanger 49 into the oil cooler 20; and a bypass path 192 that connects the main path 191*a* on the upstream side of the heat exchanger and the main path 191*b* on the downstream side of the heat exchanger to each other. The main paths 191*a* and 191*b* constitute a first path that introduces the lubricating oil into the oil cooler 20 through the heat exchanger 49 for lubricating oil exhaust heat recovery. The bypass path 192 constitutes a second path that introduces the lubricating oil into the oil cooler 20 so as to bypass the heat exchanger 49 for lubricating oil exhaust heat recovery.

The gas compressor 301 includes a path switching valve 51 that makes one of the first path (main paths 191*a* and 191*b*) and the second path (bypass path 192) communicate with the oil cooler 20. The path switching valve 51 is a three-way valve that can be switched to an enabling position and a disabling position. When the path switching valve 51 is switched to the enabling position, the path switching valve 51 makes the main paths 191*a* and 191*b* communicate with an inlet side path of the oil cooler 20, and interrupts the communication between the bypass path 192 and the inlet side path of the oil cooler 20. When the path switching valve 51 is switched to the disabling position (bypassing position), the path switching valve 51 makes the bypass path 192 communicate with the inlet side path of the oil cooler 20, and interrupts the communication between the main paths 191*a* and 191*b* and the inlet side path of the oil cooler 20.

The path switching valve 51 is switched to the enabling position or the disabling position according to a control signal from the control device 110. When an enabling signal (control signal) is input from the control device 110 to the path switching valve 51, the path switching valve 51 is switched to the enabling position. When a disabling signal (control signal) is input from the control device 110 to the path switching valve 51, the path switching valve 51 is switched to the disabling position.

As in the second embodiment, the control device 110 of the gas compressor 301 according to the present third embodiment can switch the exhaust heat recovery function during the no-load operation to an enabled state or a disabled state. Further, when the disabling condition is not satisfied, the control device 110 of the gas compressor 301 according to the third embodiment makes the main paths 191*a* and 191*b* communicate with the oil cooler 20 by the path switching valve 51. When the disabling condition is satisfied, the control device 110 of the gas compressor 301 makes the bypass path 192 communicate with the oil cooler 20 by the path switching valve 51.

Figure 7:
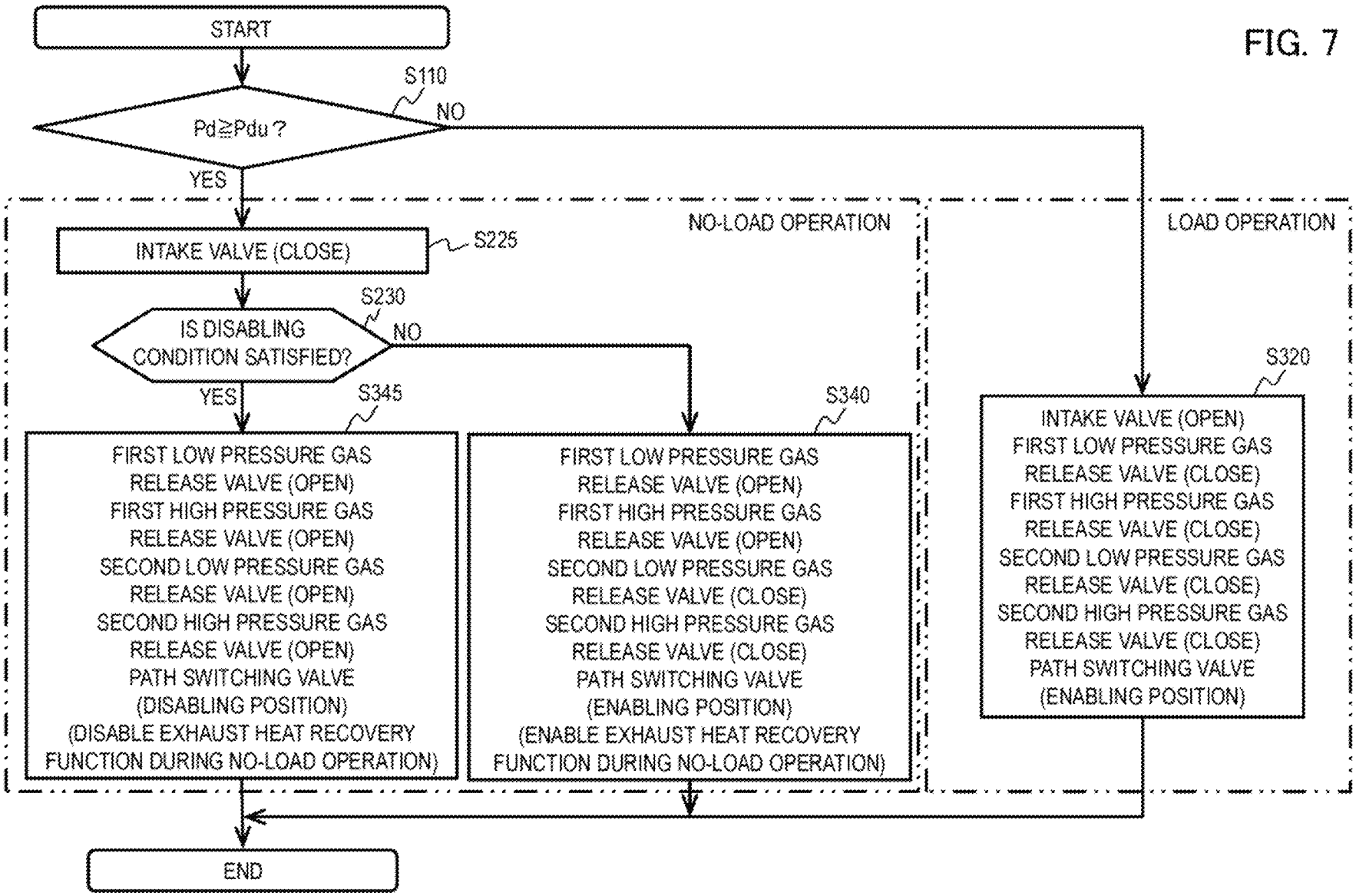
FIG. 7 is a flowchart illustrating an example of a flow of processing of valve control of the gas compression system performed by a control device according to the third embodiment.

FIG. 7 is a flowchart illustrating an example of a flow of processing of valve control of the gas compression system 300 performed by the control device 110 according to the third embodiment. In the flowchart of FIG. 7, the processing of steps S320, S340, and S345 is performed in place of the processing of steps S220, S240, and S245 in the flowchart of FIG. 5. The flowchart illustrated in FIG. 7 is, for example, started by turning on the start switch of the input device 80, and is repeatedly performed in a predetermined control cycle.

When it is determined in step S110 that the delivery pressure Pd is lower than the no-load operation start pressure Pdu, the processing proceeds to step S320. In step S320, as in step S220, the control device 110 outputs an opening signal to the intake valve 6, and outputs a closing signal to the first low pressure gas release valve 25, the first high pressure gas release valve 28, the second low pressure gas release valve 43, and the second high pressure gas release valve 46. In step S320, the control device 110 further outputs an enabling signal to the path switching valve 51.

When it is determined in step S230 that the disabling condition is not satisfied, the processing proceeds to step S340. In step S340, as in step S240, the control device 110 outputs an opening signal to the first low pressure gas release valve 25 and the first high pressure gas release valve 28, and outputs a closing signal to the second low pressure gas release valve 43 and the second high pressure gas release valve 46. In step S340, the control device 110 further outputs an enabling signal to the path switching valve 51. The control device 110 thereby enables the exhaust heat recovery function during the no-load operation.

When it is determined in step S230 that the disabling condition is satisfied, the processing proceeds to step S345. In step S345, as in step S245, the control device 110 outputs an opening signal to the first low pressure gas release valve 25, the first high pressure gas release valve 28, the second low pressure gas release valve 43, and the second high pressure gas release valve 46. In step S345, the control device 110 further outputs a disabling signal to the path switching valve 51. The control device 110 thereby disables the exhaust heat recovery function during the no-load operation.

As described above, the gas compression system 300 according to the present third embodiment includes the heat exchanger 49 for lubricating oil exhaust heat recovery that effects heat exchange between the lubricating oil and the water, and the path switching valve 51 that makes one of the first path (main paths 191*a* and 191*b*) and the second path (bypass path 192) communicate with the oil cooler 20. When the disabling condition is not satisfied, the control device 110 makes the first path (main paths 191*a* and 191*b*) and the oil cooler 20 communicate with each other by the path switching valve 51 (step S340). Thus, during the no-load operation, the lubricating oil passes through the heat exchanger 49 for lubricating oil exhaust heat recovery, and heats the water. When the disabling condition is satisfied, on the other hand, the control device 110 makes the second path (bypass path 192) and the oil cooler 20 communicate with each other by the path switching valve 51 (step S345). Thus, when the disabling condition is satisfied during the no-load operation, the lubricating oil is introduced into the oil cooler 20 so as to bypass the heat exchanger 49 for lubricating oil exhaust heat recovery.

According to this configuration, the heat of the lubricating oil can be utilized effectively during the no-load operation, and consequently the heated water having a higher temperature or in a larger amount can be supplied to the heated water using equipment (demand destination) 90. Hence, the gas compressor 301 and the gas compression system 300 according to the present third embodiment can raise the temperature of the water efficiently as compared with the second embodiment.

In addition, when there is no supply of water from the water supply source (not illustrated) to the heat exchangers 8 and 14 for exhaust heat recovery, or when the feed water temperature Tw1 is equal to or higher than the temperature threshold value Twh, the lubricating oil is introduced into the oil cooler 20 so as to bypass the heat exchanger 49 for lubricating oil exhaust heat recovery, so that power consumption of the oil pump 48 can be reduced. It is therefore possible to enhance the energy saving efficiency as compared with a case where the lubricating oil is supplied to the heat exchanger 49 for lubricating oil exhaust heat recovery at all times.

Fourth Embodiment

A gas compressor 401 and a gas compression system 400 according to a fourth embodiment of the present invention will be described with reference to FIG. 8. Incidentally, configurations identical or corresponding to the configurations described in the second embodiment are identified by the same reference numerals, and differences will be mainly described.

Figure 8:
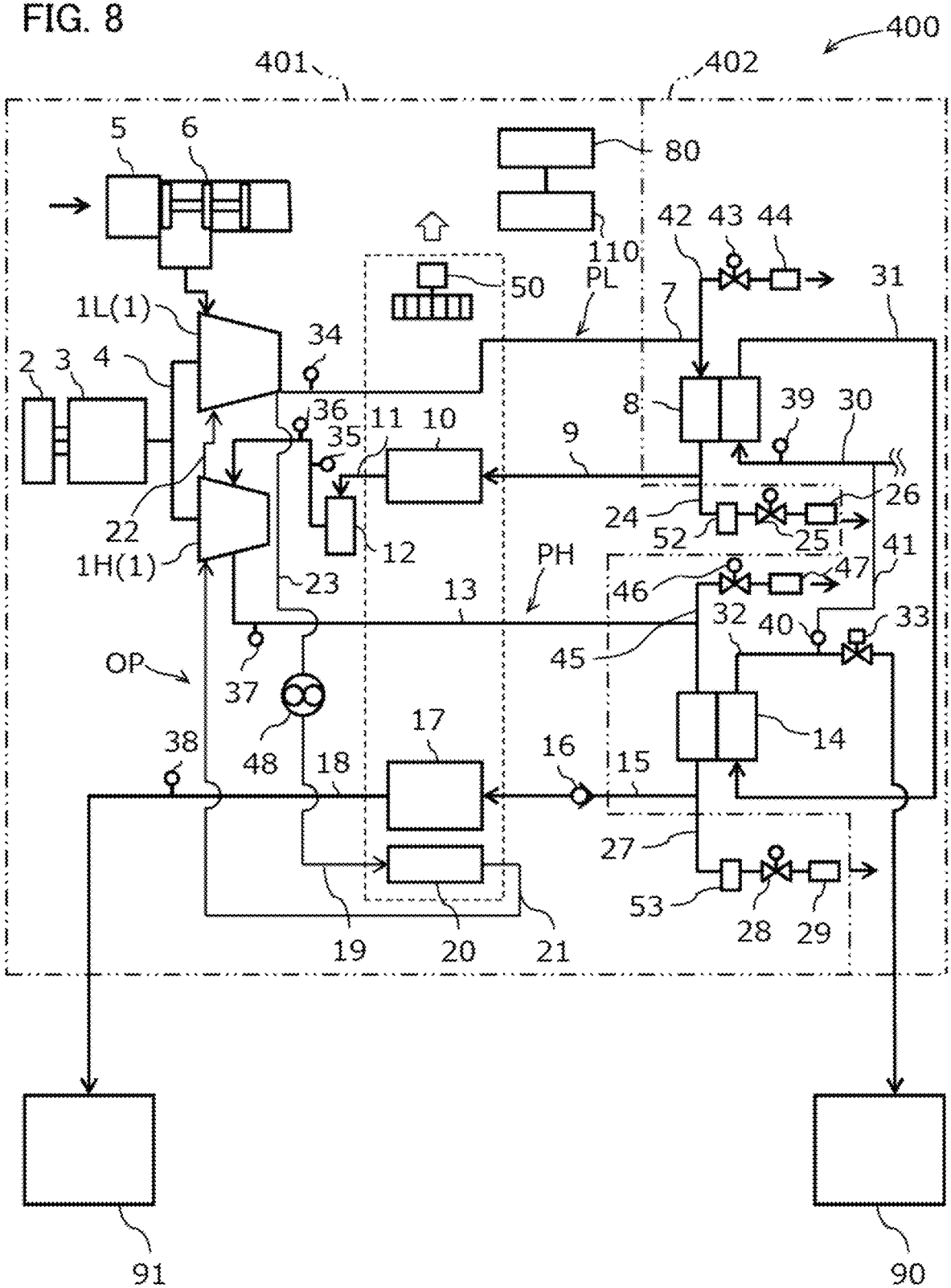
FIG. 8 is a schematic diagram illustrating a general configuration of a gas compression system according to a fourth embodiment.

FIG. 8 is a schematic diagram illustrating a general configuration of the gas compression system 400 according to the present fourth embodiment. The gas compression system 400 according to the present fourth embodiment has a configuration similar to that of the gas compression system 200 according to the second embodiment. Further, an exhaust heat recovery device 402 of the gas compression system 400 according to the fourth embodiment includes a drain separator 52 on the upstream side of the first low pressure gas release valve 25 provided on the first low pressure branch path 24 branched from the low pressure gas path PL. Similarly, the exhaust heat recovery device 402 includes a drain separator 53 on the upstream side of the first high pressure gas release valve 28 provided on the first high pressure branch path 27 branched from the high pressure gas path PH. Thus, in a case where the temperature of the water supplied to each of the heat exchangers 8 and 14 is relatively much lower than the temperature of the compressed air, or in an environment in which the relative humidity of the atmosphere is high, and therefore condensed water tends to be generated from the compressed air, it is possible to reduce a risk that the condensed water generated by cooling the compressed air by each of the heat exchangers 8 and 14 is jetted from the first low pressure gas release valve 25 and the first high pressure gas release valve 28, wets peripheral apparatuses, and consequently causes failures or soiling of the peripheral apparatuses.

The following modifications are also within the scope of the present invention. It is possible to combine a configuration illustrated in a modification and a configuration described in a foregoing embodiment with each other, combine configurations described in the foregoing different embodiments with each other, or combine configurations described in following different modifications with each other.

First Modification

In the first to third embodiments, description has been made of examples in which the gas compressors 101, 201, and 301 are a constant speed compressor. However, the present invention is not limited to this. The gas compressors 101, 201, and 301 may be, for example, a variable speed compressor in which the intake valve 6 is not provided, an inverter is provided in place of the electromagnetic switch 2, and the rotational speed of the electric motor 3 is variably controlled by the control device 110. In this case, the rotational speed of the electric motor 3 is generally reduced to a predetermined lower limit rotational speed at a same time as switching from the load operation to the no-load operation. For example, in the load operation, the control device 110 sets the first low pressure gas release valve 25 and the first high pressure gas release valve 28 in a closed state, and controls the rotational speed of the electric motor 3 within a predetermined range on the basis of the delivery pressure Pd. In addition, in the no-load operation, the control device 110 controls the rotational speed of the electric motor 3 to a lower limit rotational speed, and opens the first low pressure gas release valve 25 and the first high pressure gas release valve 28. With this configuration, an amount of sucked-in air is decreased significantly from the time of the load operation even in the absence of the intake valve 6. Therefore, during the no-load operation, by releasing the compressed air into the atmosphere through the first low pressure gas release valve 25 and the first high pressure gas release valve 28, it is possible to raise the temperature of the water flowing through the heat exchanger 14 for high pressure stage exhaust heat recovery as compared with a case where the first low pressure gas release valve 25 is not provided.

Second Modification

In the first to third embodiments, description has been made of an example in which the heat exchangers 8 and 14 are connected in series with each other such that the water flows through the heat exchanger 8 for low pressure stage exhaust heat recovery and the heat exchanger 14 for high pressure stage exhaust heat recovery in this order in the water supply system. However, the method of connecting the heat exchangers 8 and 14 is not limited to this. For example, the heat exchangers 14 and 8 may be connected in series with each other such that the water flows through the heat exchanger 14 for high pressure stage exhaust heat recovery and the heat exchanger 8 for low pressure stage exhaust heat recovery in this order in the water supply system.

In addition, in the water supply systems of the first embodiment and the second embodiment, the heat exchanger 8 for low pressure stage exhaust heat recovery and the heat exchanger 14 for high pressure stage exhaust heat recovery may be connected in parallel with each other on the downstream side of the water supply source (not illustrated). In this case, the heated water flowing out from an outlet of the low temperature fluid flow passage of the heat exchanger 8 for low pressure stage exhaust heat recovery and the heated water flowing out from an outlet of the low temperature fluid flow passage of the heat exchanger 14 for high pressure stage exhaust heat recovery may be separately introduced into the heated water using equipment 91, or may be introduced into the heated water using equipment 91 after being merged.

In the third embodiment, description has been made of an example in which the heat exchangers 49, 8, and 14 are connected in series with each other such that the water flows through the heat exchanger 49 for lubricating oil exhaust heat recovery, the heat exchanger 8 for low pressure stage exhaust heat recovery, and the heat exchanger 14 for high pressure stage exhaust heat recovery in this order in the water supply system. However, the method of connecting the heat exchangers 49, 8, and 14 is not limited to this. For example, in the water supply system, the heat exchanger 8 for low pressure stage exhaust heat recovery and the heat exchanger 14 for high pressure stage exhaust heat recovery may be connected in parallel with each other on the downstream side of the heat exchanger 49 for lubricating oil exhaust heat recovery.

Third Modification

In the second embodiment, description has been made of an example in which the disabling condition includes the first condition and the second condition. However, the present invention is not limited to this. One of the first condition and the second condition may be omitted. In other words, the disabling condition may include at least one of the first condition and the second condition.

In addition, the disabling condition may include the following third condition in place of the first condition and the second condition. Specifically, while in the second embodiment, description has been made of an example in which the exhaust heat recovery function during the no-load operation is disabled automatically, the exhaust heat recovery function during the no-load operation may be disabled manually.

Third condition: a disabling operation is performed by the input device 80.

For example, the input device 80 includes a disabling operation switch that can be operated so as to be switched between a disabling position and an enabling position. When the disabling operation switch is operated to the disabling position, a disabling operation signal is input from the input device 80 to the control device 110. When the disabling operation switch is operated to the enabling position, an enabling operation signal is input from the input device 80 to the control device 110. The control device 110 determines that the third condition is satisfied when the disabling operation switch is operated to the disabling position. The control device 110 determines that the third condition is not satisfied when the disabling operation switch is operated to the enabling position.

According to this configuration, the operator can manually disable or enable the exhaust heat recovery function during the no-load operation.

Incidentally, the disabling condition may include the third condition in addition to the first condition and the second condition. In this case, the control device 110 determines that the disabling condition is satisfied when at least one of the first condition, the second condition, and the third condition is satisfied. The control device 110 determines that the disabling condition is not satisfied when none of the first condition, the second condition, and the third condition is satisfied.

Fourth Modification

In the second embodiment and the third embodiment, description has been made of an example in which the temperature threshold value Twh is a fixed value determined in advance. However, the present invention is not limited to this. For example, the temperature threshold value Twh may be increased as the temperature of the compressed air detected by the low pressure stage delivery temperature sensor 34 and the high pressure stage delivery temperature sensor 37 rises. It is thereby possible to set the temperature threshold value Twh appropriately even when the temperature of the compressed gas changes according to seasonal changes.

Fifth Modification

In the second embodiment and the third embodiment, description has been made of an example in which the temperature threshold value Twh is determined in advance by experiment or the like on the basis of the temperature of the compressed air during the no-load operation. However, the present invention is not limited to this. The temperature threshold value Twh can be determined optionally. For example, the temperature threshold value Twh may be determined on the basis of a desired temperature of the heated water using equipment 91. For example, the temperature threshold value Twh is a value equal to or higher than the desired temperature of the heated water using equipment 91, and is stored in the nonvolatile memory 112 in advance. Incidentally, the temperature threshold value Twh may be allowed to be changed by operating an operating unit of the input device 80.

Sixth Modification

In the second embodiment and the third embodiment, description has been made of an example in which whether or not the water is being supplied to the heat exchangers 8 and 14 for exhaust heat recovery is determined on the basis of a detection result of the differential pressure sensor 40. However, the present invention is not limited to this. A flow rate sensor may be provided in place of the differential pressure sensor 40, and whether or not the water is being supplied to the heat exchangers 8 and 14 for exhaust heat recovery may be determined on the basis of a detection result of the flow rate sensor. In this case, the control device 110 determines that the first condition is satisfied when the flow rate of the water supplied to the heat exchangers 8 and 14 is equal to or lower than a flow rate threshold value. In addition, the control device 110 determines that the first condition is not satisfied when the flow rate of the water supplied to the heat exchangers 8 and 14 is higher than the flow rate threshold value.

Seventh Modification

In the first to third embodiments, description has been made of an example in which the no-load operation is performed when the delivery pressure Pd of the gas compressor 101, 201, or 301 is equal to or higher than the no-load operation start pressure Pdu, and the no-load operation is performed when the delivery pressure Pd is lower than the no-load operation start pressure Pdu. However, the present invention is not limited to this. For example, in a case where an operation for forcibly performing the no-load operation is performed by the input device 80 during the load operation, the control device 110 may perform the no-load operation even when the delivery pressure Pd is lower than the no-load operation start pressure Pdu.

Eighth Modification

In the first to third embodiments, description has been made of an example in which the input device 80 is an operation panel provided to the gas compressors 101, 201, and 301. However, the present invention is not limited to this. The input device 80 may be an external terminal device that can transmit a signal to the control device 110 from a place remote from the gas compressor 101, 201, or 301. The external terminal device is a smart phone, a notebook PC, a tablet PC, or the like that can communicate with the control device 110. In this case, by operating the external terminal device as the input device 80, the operator can start the gas compression system 100, 200, or 300, switch between the enabling and disabling of the exhaust heat recovery function during the no-load operation, or forcibly make the no-load operation performed.

Ninth Modification

In the first to third embodiments, description has been made of an example in which the gas compressors 101, 201, and 301 are a two-stage screw compressor including the low pressure stage compressor body 1L and the high pressure stage compressor body 1H. However, the configurations of the gas compressors 101, 201, and 301 are not limited to this. For example, a compressor body may be further provided on an air inlet side of the low pressure stage compressor body 1L, a compressor body may be further provided on an air outlet side of the high pressure stage compressor body 1H, or a compressor body 1 may be further provided on an air outlet side of the low pressure stage compressor body 1L and on an air inlet side of the high pressure stage compressor body 1H.

Tenth Modification

The gas compression system 100, 200, or 300 may be provided with a plurality of gas compressors 101, 201, or 301. When a gas compression system includes a plurality of gas compressors, the operation of each gas compressor may be controlled such that the plurality of gas compressors are made to perform the load operation sequentially. The control device 110 performs control so as to switch between the load operation and the no-load operation of the gas compressors in order to level operation times. In this case, when a predetermined gas compressor is switched from the load operation to the no-load operation, the control device 110 can perform the exhaust heat recovery from the compressed air of the predetermined gas compressor by opening the first low pressure gas release valve 25 and the first high pressure gas release valve 28 of the predetermined gas compressor.

Eleventh Modification

Description has been made of an example in which when the disabling condition is satisfied, the control device 110 according to the second embodiment and the third embodiment opens the first low pressure gas release valve 25, the first high pressure gas release valve 28, the second low pressure gas release valve 43, and the second high pressure gas release valve 46 at a time of switching from the load operation to the no-load operation of the compressor body 1.

However, the present invention is not limited to this. When the disabling condition is satisfied, it suffices for the control device 110 to open at least the second low pressure gas release valve 43 and the second high pressure gas release valve 46 at the time of switching from the load operation to the no-load operation of the low pressure stage compressor body 1L and the high pressure stage compressor body 1H. That is, the control device 110 may leave the first low pressure gas release valve 25 and the first high pressure gas release valve 28 closed.

Opening at least the second low pressure gas release valve 43 and the second high pressure gas release valve 46 among the first low pressure gas release valve 25, the first high pressure gas release valve 28, the second low pressure gas release valve 43, and the second high pressure gas release valve 46 can suppress a pressure loss in the heat exchangers 8 and 14 as compared with a case of opening only the first low pressure gas release valve 25 and the first high pressure gas release valve 28. It is thereby possible to disable the exhaust heat recovery function while reducing power consumption of the electric motor 3.

In addition, when the disabling condition is satisfied, the control device 110 according to the second embodiment and the third embodiment does not need to open the first low pressure gas release valve 25, the first high pressure gas release valve 28, the second low pressure gas release valve 43, and the second high pressure gas release valve 46 in the same timing at the time of switching from the load operation to the no-load operation of the compressor body 1. For example, the control device 110 may open the second low pressure gas release valve 43 and the second high pressure gas release valve 46, and thereafter open the first low pressure gas release valve 25 and the first high pressure gas release valve 28 in a shifted timing.

Twelfth Modification

The configurations of the exhaust heat recovery devices 102, 202, and 302 are not limited to the examples described in the foregoing embodiments. For example, the exhaust heat recovery devices may include a flow rate adjusting device that adjusts the flow rate of the water according to the temperature of the water flowing out from the heat exchanger 14 for high pressure stage exhaust heat recovery (exhaust heat recovery outlet temperature). The flow rate adjusting device includes, for example, a temperature sensor, a temperature controller, and a temperature control valve provided downstream of the heat exchanger 14 for high pressure stage exhaust heat recovery in the water supply system. The temperature sensor detects the water outlet temperature of the exhaust heat recovery device, and outputs a signal indicating a result of the detection to the temperature controller. The temperature controller controls the opening/closing angle of the temperature control valve according to the water outlet temperature of the exhaust heat recovery device detected by the temperature sensor, and thus controls the flow rate. The temperature controller controls the flow rate by the temperature control valve such that the water outlet temperature of the exhaust heat recovery device falls within a predetermined temperature range.

When the flow rate adjusting device is provided in the above-described comparative example in which the first low pressure branch path 24 and the first low pressure gas release valve 25 are not provided, the temperature of the compressed air is decreased during the no-load operation as compared with the case of the load operation. Consequently, the opening/closing angle of the temperature control valve is decreased, so that the amount of the water is reduced. As a result, in this modification, the amount of the heated water that can be extracted from the exhaust heat recovery device during the no-load operation may be significantly decreased as compared with the case of the load operation.

On the other hand, the present twelfth modification is provided with the first low pressure branch path 24 and the first low pressure gas release valve 25. Therefore, not only the first high pressure gas release valve 28 but also the first low pressure gas release valve 25 is opened at the time of switching from the load operation to the no-load operation. The temperature of the water flowing out from the heat exchanger 14 for high pressure stage exhaust heat recovery during the no-load operation can therefore be made higher than that in the comparative example. Because the temperature of the water can be raised, the amount of the heated water that can be extracted from the exhaust heat recovery device can be made larger than that in the comparative example. The present twelfth modification can provide a gas compressor and a gas compression system that can suppress decreases in the temperature of the water and the amount of the heated water during the no-load operation.

Thirteenth Modification

In the first to third embodiments, description has been made of an example in which the gas compressors 101, 201, and 301 are an oilless screw compressor including a pair of female and male screw rotors. However, the present invention is not limited to this. The gas compressors may be a single screw compressor including one screw rotor. In addition, the gas compressors may be a scroll compressor, a roots blower, a reciprocating compressor, or the like.

Fourteenth Modification

In the first to third embodiments, an example has been illustrated in which the exhaust heat recovery fluid passing through the low temperature fluid flow passages of the heat exchanger 8 for low pressure stage exhaust heat recovery and the heat exchanger 14 for high pressure stage exhaust heat recovery is water. However, the exhaust heat recovery fluid is not limited to water, but may be a coolant liquid including an antifreeze component such as alcohol, an oil, or the like.

Fifteenth Modification

In the first to third embodiments, description has been made of an example in which the intercooler 10, the aftercooler 17, and the oil cooler 20 are an air-cooled heat exchanger using cooling air as a cooling medium. However, the intercooler 10, the aftercooler 17, and the oil cooler 20 may be a liquid-cooled (water-cooled) heat exchanger using a liquid such as cooling water as a cooling medium.

Sixteenth Modification

In the first to third embodiments, description has been made of an example in which the driving structure of the compressor body 1 is a structure that transmits the power of one electric motor 3 to the low pressure stage compressor body 1L and the high pressure stage compressor body 1H via the speed increasing device 4. However, the present invention is not limited to this. For example, the low pressure stage compressor body 1L and the high pressure stage compressor body 1H may each be directly connected to one independent electric motor without the intervention of the speed increasing device 4. That is, the driving structure of the compressor body 1 may be a structure that transmits the power of a first electric motor to the low pressure stage compressor body 1L, and transmits the power of a second electric motor to the high pressure stage compressor body 1H.

Seventeenth Modification

The oil pump 48 may be driven by the electric motor 3, or may be driven by another electric motor than the electric motor 3.

Eighteenth Modification

In the first to third embodiments, description has been made of an example in which the gas compressed by the gas compressors 101, 201, and 301 is air, and the compressed air is released from the gas release valves into the atmosphere. However, the present invention is not limited to this. For example, the gas compressed by the gas compressors may be nitrogen. In addition, the gas release valves may be connected to a gas tank having a low pressure compared with the gas system, and the compressed gas may be released from the gas release valves into the gas tank.

Nineteenth Modification

The electromagnetic intake valve control valve for opening and closing the intake valve 6 illustrated in the first to third embodiment may be provided separately from the intake valve 6. An output signal from the control device 110 is transmitted to the intake valve control valve, and when the intake valve control valve is opened or closed, the intake valve 6 is opened or closed by the driving force of the gas pressure (air pressure) delivered from the low pressure stage compressor body 1L or the high pressure stage compressor body 1H.

Embodiments of the present invention have been described above. However, the foregoing embodiments merely represent a part of examples of application of the present invention, and are not intended to limit the technical scope of the present invention to concrete configurations of the foregoing embodiments.

DESCRIPTION OF REFERENCE CHARACTERS

1: Compressor body
1H: High pressure stage compressor body
1L: Low pressure stage compressor body
2: Electromagnetic switch
3: Electric motor
5: Intake air filter
6: Intake valve (control valve)
7: Air path
8: Heat exchanger for low pressure stage exhaust heat recovery
9: Air path
10: Intercooler
11: Air path
12: Condensed water separator
13: Air path
14: Heat exchanger for high pressure stage exhaust heat recovery
15: Air path
16: Check valve
17: Aftercooler
18: Air path
19: Oil supply path
20: Oil cooler
21: Oil supply path
22: Oil supply path
23: Return path
24: First low pressure branch path
25: First low pressure gas release valve
27: First high pressure branch path
28: First high pressure gas release valve
30: First supply flow passage
30A: Upstream side first supply flow passage
30B: Downstream side first supply flow passage
31: Second supply flow passage
32: Third supply flow passage
33: Water supply valve
34: Low pressure stage delivery temperature sensor
35: High pressure stage suction temperature sensor
36: High pressure stage suction pressure sensor
37: High pressure stage delivery temperature sensor
38: Delivery pressure sensor
39: Feed water temperature sensor (temperature sensor)
40: Differential pressure sensor
41: Pressure detection pipe
42: Second low pressure branch path
43: Second low pressure gas release valve
44: Muffler
45: Second high pressure branch path
46: Second high pressure gas release valve
47: Muffler
48: Oil pump
49: Heat exchanger for lubricating oil exhaust heat recovery
50: Cooling fan
51: Path switching valve
80: Input device
90: Heated water using equipment (demand destination)
91: Air using equipment (demand destination)

100: Gas compression system
101: Gas compressor
102: Exhaust heat recovery device
110: Control device
111: Processing device
112: Nonvolatile memory
113: Volatile memory
114: Input interface
115: Output interface
191*a*: Main path (first path)
191*b*: Main path (first path)
192: Bypass path (second path)
200: Gas compression system
201: Gas compressor
202: Exhaust heat recovery device
300: Gas compression system
301: Gas compressor
302: Exhaust heat recovery device
OP: Lubricating oil path
PL: Low pressure gas path
PH: High pressure gas path

The invention claimed is:

1. A gas compression system comprising:

a gas compressor including a low pressure stage compressor body that compresses gas, an intercooler that cools compressed gas delivered from the low pressure stage compressor body, a high pressure stage compressor body that further compresses the compressed gas cooled by the intercooler, an aftercooler that cools the compressed gas delivered from the high pressure stage compressor body, a low pressure gas path that introduces the compressed gas delivered from the low pressure stage compressor body into the high pressure stage compressor body through the intercooler, and a high pressure gas path that introduces the compressed gas delivered from the high pressure stage compressor body to a demand destination through the aftercooler, the gas compressor comprising:

a first low pressure branch path that is branched from the low pressure gas path;

a first low pressure gas release valve that is disposed on the first low pressure branch path and releases the compressed gas delivered from the low pressure stage compressor body;

a first high pressure branch path that is branched from the high pressure gas path;

a first high pressure gas release valve that is disposed on the first high pressure branch path and releases the compressed gas delivered from the high pressure stage compressor body; and a control device that controls the first low pressure gas release valve and the first high pressure gas release valve, the first low pressure branch path being branched from the low pressure gas path on an upstream side of the intercooler and on a downstream side of a heat exchanger for low pressure stage exhaust heat recovery that effects heat exchange between the compressed gas delivered from the low pressure stage compressor body and a fluid for exhaust heat recovery, the first high pressure branch path being branched from the high pressure gas path on an upstream side of the aftercooler and on a downstream side of a heat exchanger for high pressure stage exhaust heat recovery that effects heat exchange between the compressed gas delivered from the high pressure stage compressor body and the fluid for exhaust heat recovery, the control device effecting heat exchange between the compressed gas and the exhaust heat recovery fluid that pass through the heat exchanger for low pressure stage exhaust heat recovery and the heat exchanger for high pressure stage exhaust heat recovery, while releasing the compressed gas from the first low pressure gas release valve and the first high pressure gas release valve during no-load operation, by opening the first low pressure gas release valve and the first high pressure gas release valve at a time of switching from load operation to the no-load operation of the low pressure stage compressor body and the high pressure stage compressor body;

a second low pressure branch path branched from the low pressure gas path on an upstream side of the heat exchanger for low pressure stage exhaust heat recovery;

a second low pressure gas release valve disposed on the second low pressure branch path;

a second high pressure branch path branched from the high pressure gas path on an upstream side of the heat exchanger for high pressure stage exhaust heat recovery; and a second high pressure gas release valve disposed on the second high pressure branch path, the control device being configured to determine whether or not a disabling condition for disabling an exhaust heat recovery function during the no-load operation is satisfied, when the disabling condition is not satisfied, open the first low pressure gas release valve and the first high pressure gas release valve and close the second low pressure gas release valve and the second high pressure gas release valve at the time of switching from the load operation to the no-load operation of the low pressure stage compressor body and the high pressure stage compressor body, and when the disabling condition is satisfied, open at least the second low pressure gas release valve and the second high pressure gas release valve at the time of switching from the load operation to the no-load operation of the low pressure stage compressor body and the high pressure stage compressor body.

2. The gas compression system according to claim 1, wherein the disabling condition includes at least one of a condition that at least one of the heat exchanger for low pressure stage exhaust heat recovery and the heat exchanger for high pressure stage exhaust heat recovery is not supplied with the exhaust heat recovery fluid, and a condition that a temperature of the exhaust heat recovery fluid supplied to at least one of the heat exchanger for low pressure stage exhaust heat recovery and the heat exchanger for high pressure stage exhaust heat recovery is higher than a temperature threshold value.

3. The gas compression system according to claim 1, wherein the gas compression system includes an input device operable by an operator, and the disabling condition includes a condition that a disabling operation is performed by the input device.

4. The gas compression system according to claim 1, wherein the gas compression system includes a lubricating oil path through which a lubricating oil that lubricates the low pressure stage compressor body and the high pressure stage compressor body flows, an oil cooler that is disposed on the lubricating oil path and cools the lubricating oil, the lubricating oil path including a first path that introduces the lubricating oil into the oil cooler through a heat exchanger for lubricating oil exhaust heat recovery that effects heat exchange between the lubricating oil and the fluid for exhaust heat recovery and a second path that introduces the lubricating oil into the oil cooler so as to bypass the heat exchanger for lubricating oil exhaust heat recovery, and a path switching valve that makes one of the first path and the second path communicate with the oil cooler, and the control device is configured to make the first path and the oil cooler communicate with each other by the path switching valve when the disabling condition is not satisfied, and make the second path and the oil cooler communicate with each other by the path switching valve when the disabling condition is satisfied.

5. A gas compression system comprising:

the gas compressor according to claim 2;

the heat exchanger for low pressure stage exhaust heat recovery disposed on the low pressure gas path; and the heat exchanger for high pressure stage exhaust heat recovery disposed on the high pressure gas path.

6. The gas compression system according to claim 1, wherein the gas compression system includes the heat exchanger for low pressure stage exhaust heat recovery disposed on the low pressure gas path, the heat exchanger for high pressure stage exhaust heat recovery disposed on the high pressure gas path, a first supply flow passage that supplies the exhaust heat recovery fluid to the heat exchanger for low pressure stage exhaust heat recovery, a second supply flow passage that supplies the exhaust heat recovery fluid discharged from the heat exchanger for low pressure stage exhaust heat recovery to the heat exchanger for high pressure stage exhaust heat recovery, a third supply flow passage that supplies the exhaust heat recovery fluid discharged from the heat exchanger for high pressure stage exhaust heat recovery to a demand destination, a differential pressure sensor that detects a differential pressure between a pressure of the exhaust heat recovery fluid within the first supply flow passage and a pressure of the exhaust heat recovery fluid within the third supply flow passage, and a temperature sensor that detects a temperature of the exhaust heat recovery fluid, and the control device is configured to determine whether or not the disabling condition is satisfied on a basis of a detection result of the differential pressure sensor and a detection result of the temperature sensor, determine that the disabling condition is satisfied when the differential pressure detected by the differential pressure sensor is lower than a differential pressure threshold value or when the temperature detected by the temperature sensor is higher than a temperature threshold value, determine that the disabling condition is not satisfied when the differential pressure detected by the differential pressure sensor is higher than the differential pressure threshold value and when the temperature detected by the temperature sensor is lower than the temperature threshold value, when the disabling condition is not satisfied, open the first low pressure gas release valve and the first high pressure gas release valve and close the second low pressure gas release valve and the second high pressure gas release valve at the time of switching from the load operation to the no-load operation of the low pressure stage compressor body and the high pressure stage compressor body, and when the disabling condition is satisfied, open the first low pressure gas release valve, the first high pressure gas release valve, the second low pressure gas release valve, and the second high pressure gas release valve at the time of switching from the load operation to the no-load operation of the low pressure stage compressor body and the high pressure stage compressor body.

7. The gas compression system according to claim 6, wherein the gas compression system includes a lubricating oil path through which a lubricating oil that lubricates the low pressure stage compressor body and the high pressure stage compressor body flows, an oil cooler that is disposed on the lubricating oil path and cools the lubricating oil, a heat exchanger for lubricating oil exhaust heat recovery that is disposed on the lubricating oil path and that effects heat exchange between the lubricating oil and the fluid for exhaust heat recovery, the lubricating oil path including a first path that introduces the lubricating oil into the oil cooler through the heat exchanger for lubricating oil exhaust heat recovery and a second path that introduces the lubricating oil into the oil cooler so as to bypass the heat exchanger for lubricating oil exhaust heat recovery, and a path switching valve that makes one of the first path and the second path communicate with the oil cooler, and the control device is configured to make the first path and the oil cooler communicate with each other by the path switching valve when the disabling condition is not satisfied, and make the second path and the oil cooler communicate with each other by the path switching valve when the disabling condition is satisfied.

* * * * *